US007036798B1

(12) United States Patent
Olson

(10) Patent No.: US 7,036,798 B1
(45) Date of Patent: May 2, 2006

(54) MOBILE BARRIER TO CONTROL LITTER AND WIND

(76) Inventor: Michael A. Olson, 2510 Elmwood Ave., Ann Arbor, MI (US) 48104

( * ) Notice: Subject to any disclaimer, the term of this patent is extended or adjusted under 35 U.S.C. 154(b) by 0 days.

(21) Appl. No.: 10/426,190

(22) Filed: Apr. 30, 2003

Related U.S. Application Data

(60) Provisional application No. 60/376,487, filed on Apr. 30, 2002.

(51) Int. Cl.
*E01F 7/02* (2006.01)

(52) U.S. Cl. ..... 256/12.5; 256/24; 256/65.14; 239/289; 405/302.6

(58) Field of Classification Search ..... 405/144, 405/21, 22, 31, 302.6; 299/12; 160/351, 160/44; 256/13, 15, 12.5, 24–26, 65.01, 256/65.14, DIG. 2; 52/169.1–169.4; 404/6, 404/9; 40/610, 607.04, 607.1; 239/289
See application file for complete search history.

(56) References Cited

U.S. PATENT DOCUMENTS

| | | | | | |
|---|---|---|---|---|---|
| 117,749 | A | * | 8/1871 | Dean | 160/44 |
| 334,078 | A | * | 1/1886 | Latimer | 239/44 |
| 1,000,236 | A | * | 8/1911 | Cochrane | 169/56 |
| 2,193,062 | A | * | 3/1940 | De Land | 47/22.1 |
| 2,888,072 | A | * | 5/1959 | Nicholas | 160/377 |
| 3,187,761 | A | * | 6/1965 | De Maio | 135/118 |
| 3,236,481 | A | * | 2/1966 | Howard | 248/475.1 |
| 3,281,986 | A | * | 11/1966 | Les | 47/9 |
| 3,425,630 | A | * | 2/1969 | Fessler, Sr. | 239/208 |
| 3,648,980 | A | * | 3/1972 | Taylor | 256/12.5 |
| 4,085,789 | A | * | 4/1978 | Steiner et al. | 160/135 |
| 4,127,196 | A | * | 11/1978 | Boucher | 211/207 |
| 4,157,204 | A | * | 6/1979 | Kissell et al. | 299/64 |
| 4,339,114 | A | * | 7/1982 | Deike | 256/12.5 |
| 4,358,160 | A | * | 11/1982 | Kissell et al. | 299/43 |
| 4,368,586 | A | * | 1/1983 | Forzelias | 40/604 |
| 4,440,070 | A | * | 4/1984 | Baker et al. | 454/170 |
| D279,942 | S | * | 8/1985 | Vasquez et al. | D6/332 |
| 4,549,724 | A | * | 10/1985 | Taillandier | 256/12.5 |
| 4,671,495 | A | * | 6/1987 | Garland et al. | 256/12.5 |
| 4,770,086 | A | * | 9/1988 | Gabster | 454/170 |
| 4,838,525 | A | * | 6/1989 | Snow et al. | 256/26 |

(Continued)

FOREIGN PATENT DOCUMENTS

DE 3911637 A1 * 10/1990

(Continued)

OTHER PUBLICATIONS

WWW.trashstop.net/contact_US.htm.

*Primary Examiner*—Michael Safavi
*Assistant Examiner*—Gay Ann Spahn
(74) *Attorney, Agent, or Firm*—Robert L. McKellar; McKellar IP Law, PLLC

(57) ABSTRACT

A mobile barrier for use in wind control, reduction of blowing litter and suspension and transport of airborne contaminants with applications in areas of landfill maintenance, agriculture, erosion control, and snow control is described. The mobile barrier is a large mesh panel supported in an orientation that is at a slight angle to the vertical. The panel is supported using a pair of upright members that extend upward from a base which is freestanding. A vertically adjustable lifting boom is also supported by the upright members, and is used to secure the mobile barrier to lifting machinery for purposes of transport. Further, a system for controlling the spread of wind-borne contaminants will be described which includes a mobile barrier in combination with a misting device.

14 Claims, 14 Drawing Sheets

U.S. PATENT DOCUMENTS 4,932,354 A * 6/1990 Kistner ..... 118/305
5,042,557 A * 8/1991 Norsworthy ..... 160/351
5,213,312 A 5/1993 MacDonald
5,269,623 A * 12/1993 Hanson ..... 404/6
5,402,988 A * 4/1995 Eisele ..... 256/24
5,407,178 A * 4/1995 Long ..... 256/45
5,645,271 A * 7/1997 Nunez ..... 256/67
5,661,944 A * 9/1997 Specht ..... 52/656.8
D396,065 S * 7/1998 Johnson et al. ..... D20/41
5,779,227 A * 7/1998 Elkins et al. ..... 256/31
5,813,662 A * 9/1998 Langkruis ..... 256/25
5,875,597 A * 3/1999 Gingrich et al. ..... 52/239
5,878,802 A * 3/1999 Richter et al. ..... 160/135
5,941,002 A * 8/1999 Rusin ..... 40/611.06
6,092,792 A * 7/2000 Camara ..... 256/24
6,162,118 A * 12/2000 Arts et al. ..... 454/49
6,182,740 B1 * 2/2001 Pfaff ..... 160/351
6,375,584 B1 * 4/2002 Shapiro ..... 473/419
6,481,926 B1 11/2002 Benedict et al.
6,622,607 B1 * 9/2003 Miller ..... 89/36.07
2002/0000301 A1 * 1/2002 Rolin ..... 160/330
2003/0089461 A1 * 5/2003 Dondlinger ..... 160/84.06
2003/0146426 A1 * 8/2003 Ray et al. ..... 256/59
2004/0112550 A1 * 6/2004 Green ..... 160/135

FOREIGN PATENT DOCUMENTS

GB 2067628 A * 7/1981

* cited by examiner

MOBILE BARRIER TO CONTROL LITTER AND WIND

This application claims the benefit of U.S. Provisional Application No. 60/376,487 filed on Apr. 30, 2002.

This invention relates to control of blowing litter from sanitary landfill operations, specifically to an improved mobile barrier to reduce blowing litter. This invention also relates to control of wind in the presence of earthwork, landfill, and surface mining operations, specifically to an improved mobile barrier to reduce wind speed and thereby reduce suspension and transport of airborne contaminants from these operations. Further, this invention relates to a misting system that is externally mounted to the mobile barrier to further reduce airborne emissions from these operations. Lastly, this invention relates to control of wind in the fields of agriculture, erosion control, and snow control.

BACKGROUND OF THE INVENTION

Control of Litter

As sanitary landfills continue to grow higher in elevation, and as surrounding areas continue to be developed, landfill operators are facing increasing problems with blowing litter. Blowing litter causes complaints from neighbors, citations from regulatory agencies, and labor cost to clean it up. Landfill operators use operational precautions, such as coordinating waste receipts and waste placement with wind conditions, to control blowing litter. However, extreme winds, or any winds during a lapse in these precautions, can cause litter transport far beyond landfill boundaries. Landfill operators also use stationary fencing around the perimeter of a landfill site to control blowing litter. However this fencing is only partially effective. The fencing is stationary and cannot be moved to adjust to changing site and wind conditions. It is also often far away from the active waste face, the source of the litter. Litter often blows upward and outward from the active face, high above and over stationary fencing.

Landfill operators also fabricate large mobile barriers on-site, in a variety of forms and dimensions, to reduce blowing litter. These devices consist of a steel skid or truck and framework to position and support a large area of open screen material downwind of the active waste face. The screen material is typically chain-link fencing, welded wire, expanded steel, or plastic construction fencing. The screen lets wind pass through, but stops litter. There are a variety of methods to move these mobile barriers to adjust to changing site and wind conditions. Some mobile barriers are mounted on skids, while others are mounted on a passive truck with wheels and tires. These mobile barriers can be pulled or pushed over the ground. Yet other barriers have a lifting bale that provides for picking up and moving the barrier with the blade of a bullzoder or landfill compactor (hereinafter "machine"). These mobile barriers can prevent litter from blowing beyond landfill boundaries. However they have several common deficiencies that impair their performance and utility:

They are not as mobile as they need to be. They lack provisions for readily moving them to the most appropriate location to adjust to changing site and wind conditions, in time to be effective. Barriers on skids or trucks are difficult and time-consuming to pull or push across unstable ground without sticking or damage. Tires become punctured and flattened when rolled over refuse. Pulling these barriers requires the machine operator to dismount the machine to hook up to the barrier. This is undesirable in areas of treacherous ground or during inclement weather. Lifting bales are not adjustable and can only accommodate one particular machine. Also, the bales are usually on the downwind side of the barrier, requiring the machine to traverse around the barrier to pick it up. Because of these difficulties the barriers typically stay in one place even as the waste face constantly moves throughout the life of the landfill and as wind conditions change. Therefore they are seldom positioned in the most appropriate location to effectively control litter.

They are not suitable for positioning close to, or within, the active waste face that is the source of the litter. They sink into unstable refuse or ground, get stuck, or tip over. They are difficult to remove or right without damage. Consequently they are positioned at some distance from the active face, in more stable ground. This substantially increases the perimeter along which they are to intercept blowing litter, thereby requiring more barriers than if they could be positioned closer to the active face. As blowing litter rises outward and upward from the active face, it is more likely to blow high above and over these mobile barriers.

Their screens have catches, pinch points, and obstructions that tend to trap litter against the screen, even after the wind has subsided. This "blinding" is unsightly, reduces effectiveness of the barriers, and increases wind loads, making the barriers prone to tipping.

Plastic construction fencing is prone to wind buffeting and resulting premature failure.

Their designs do not consider the full loading of high winds and they are therefore prone to tipping.

They are difficult to position end-to-end with the result of allowing gaps in coverage. Consequently litter blows through, between the ends of multiple barriers.

They are not matched in scale to the heavy machinery with which they are used. They are often frail structures in comparison to these machines, difficult to see and easy to damage.

They have no provisions for convenient disassembly and reassembly that would be necessary, because of their large size, to ship them to or from landfill sites. By "convenient" I mean that disassembly and reassembly would require no cutting or welding of steel. Consequently they must be custom-fabricated on-site, generally under inadequate conditions to produce effective barriers at reasonable cost. Therefore the barriers do not lend themselves to economies of standardization, interchangeable parts, mass production, and shipping efficiency.

Known mobile barriers can control blowing litter. However, the aforementioned deficiencies impair their performance and utility to the point where they are not very effective. Ineffective litter control is a liability to the landfill operator in the form of neighbor complaints, regulatory citations, and clean-up costs. Therefore there is a need for an improved mobile barrier to control blowing litter.

Control of Wind

As public awareness of air quality continues to increase, and as governments respond with stricter laws and regulations, suspension and transport of airborne contaminants is an increasing problem for earthwork, landfill, and surface mining operations. The airborne contaminants are typically gasses, vapors, dust, and litter. Controlling wind across the active face of these operations can reduce suspension and transport of these contaminants.

Wind barriers can control wind speed across the active face of earthwork, landfill, and surface mining operations, thereby reducing suspension and transport of airborne contaminants. Wind barriers are also known in the fields of agriculture, erosion control, and snow control. In these applications, they protect sensitive crops from wind damage, protect sensitive soils from wind erosion, and prevent snow drifting over roads.

Known wind barriers consist of stationary fencing of wind-reducing lath or fabric. The lath or fabric has an "aerodynamic opacity" that lets some wind through, thereby reducing wind speed without causing turbulence. They are installed upwind of an active face. These barriers can reduce suspension and transport of airborne contaminants beyond site boundaries. However they have some deficiencies that impair their performance and utility:

Because of their aerodynamic opacity they are prone to high wind loads, often resulting in damage, tipping, and failure.

The wind-reducing fabric is prone to wind buffeting and resulting premature failure.

They are not suitable for positioning close to, or within, the active face that is the source of the airborne contaminants. This substantially increases the perimeter along which they are to control wind, thereby requiring more barriers than if they could be positioned closer to the face.

They are not mobile and therefore cannot adjust to changing site and wind conditions.

Although they reduce suspension and transport of airborne contaminants, such suspension and transport remains a significant problem.

Known wind barriers can control wind, thereby reducing suspension of airborne contaminants from earthwork, landfill, and surface mining operations. However, the aforementioned deficiencies, particularly their lack of mobility, impair their performance and utility to the point where they are not very effective. Ineffective control of airborne contaminants is a liability to these operations in the form of neighbor complaints and regulatory citations. Therefore there is a need for an improved mobile barrier to control wind and to reduce and control airborne contaminants.

Misting Systems

Misting systems are a known means to control suspension and transport of airborne contaminants from earthwork, landfill, and surface mining operations. They work in two ways: wetting and cooling. Misting systems control dust by wetting dust particles with water mist, thereby adding weight to the particles and providing adhesion between particles. In this case the misting system produces fluid droplets which are relatively large. In cooling applications, misting systems control volatilization of gasses and vapors by evaporative cooling thereby reducing volatilization rates of the source. Misting systems may also be used to dispense odor suppressants into the air, thereby reducing offensive odors from landfills and the like. Misting systems have also been used to dispense bird repellents to control the feeding of seagulls and other avian species at landfills. In the cases of odor and bird control and evaporative cooling, the misting system produces fluid droplets which are very small.

There are several disadvantages to known misting systems. The most important disadvantage occurs when misting systems are used in open air operations. Frequently mist applied in open air operations is blown away by wind before it has beneficial effect, and it is difficult to retain the mist where it is needed. There are also problems with autonomy and mobility of known misting systems. Known systems usually rely on external power and water and are not suited to moving around a landfill, for example, on a daily basis. Lastly, most commercially available systems lack convenient operational control and are prone to excessive water consumption and accumulation on the ground.

SUMMARY OF THE INVENTION

The present invention is directed to an improved mobile barrier which is uniquely designed to control blowing litter, wind speed, and turbulence. The mobile barrier consists of a mesh panel supported in an orientation which is at a slight angle to the vertical. The panel is supported using a pair of upright members which extend upward from a base which is freestanding and provides a large footprint. A vertically adjustable lifting boom is also supported by the upright members, and is used to secure the mobile barrier to lifting machinery for purposes of transport. Further, a system for controlling the spread of wind-borne contaminants will be described which includes a mobile barrier in combination with a misting device.

Several objects and advantages of my improved mobile barrier are:

It is truly mobile and easy to move to the most appropriate location. This allows real-time adjustment to changing site and wind conditions. It has an adjustable lifting boom that can accommodate a variety of machines, from a small machine like a Caterpillar D5 bulldozer, to a large machine like a Caterpillar 836 landfill compactor. The lifting boom is on the front side of the barrier where the machines are working and therefore does not require traversing around the barrier to pick it up.

It is suitable for positioning close to, or within, the active face, thereby increasing effectiveness of control of litter and wind. It has a smooth stable base that is not prone to sticking, sinking, or tipping in unstable ground. Should these occur, the robust base, uprights, and lifting boom provide for easily removing or righting the barrier without damage.

It has screen panels that are planar and free of catches, pinch points, and obstructions that tend to trap litter against the screen, even after the wind has subsided. This provides for better appearance, and reduces wind loads and tipping.

It has screens that are made of steel and not prone to wind buffeting and failure.

It has a wide stable base and is less prone to tipping in high winds.

It provides for multiple barriers to be easily positioned end-to-end, with a slight overlap. This prevents litter and wind from blowing through, between the ends of multiple barriers.

It is matched in scale to the machines with which it is used. It is a robust structure that is easy to see and less prone to damage by these machines.

It provides for convenient disassembly and reassembly, requiring no cutting or welding of steel. It folds compactly, and multiple folded units stack securely, so that six complete units will fit on a standard 8'×40' trailer, with no blocking, bracing, or cribbing. These advantages provide for off-site fabrication; and economies of standardization, interchangeable parts, mass production, and shipping efficiency. For example they can be moved from site to site as necessary.

It has interchangeable screen panels that allow for dual use of the barriers. "Open" panels provide for controlling litter. "Closed" panels provide for controlling wind.

When a mobile barrier is equipped with a misting system, the combination mobile barrier-misting device is an autonomous, mobile system allowing easy movement and operation throughout a site.

When the mobile barrier is equipped with a misting system, the combination mobile barrier-misting device prevents the wind from blowing the mist away and thereby retains mist where it is needed.

It is convenient to think of my mobile barrier as a delivery system that is optimized to position and support a relatively fragile screen material in the rugged environments of earthwork, landfill, or surface mining operation. This design approach distributes the weight of mobile barrier downward and outward, providing for durability and stability of the mobile barrier as a whole. The delivery system is also optimized for shipping efficiency. Further objects and advantages of my improved mobile barrier will become apparent from consideration of the drawings and ensuing description.

DESCRIPTION OF THE INVENTION

The present invention will now be described with reference to the figures.

Figure 1:
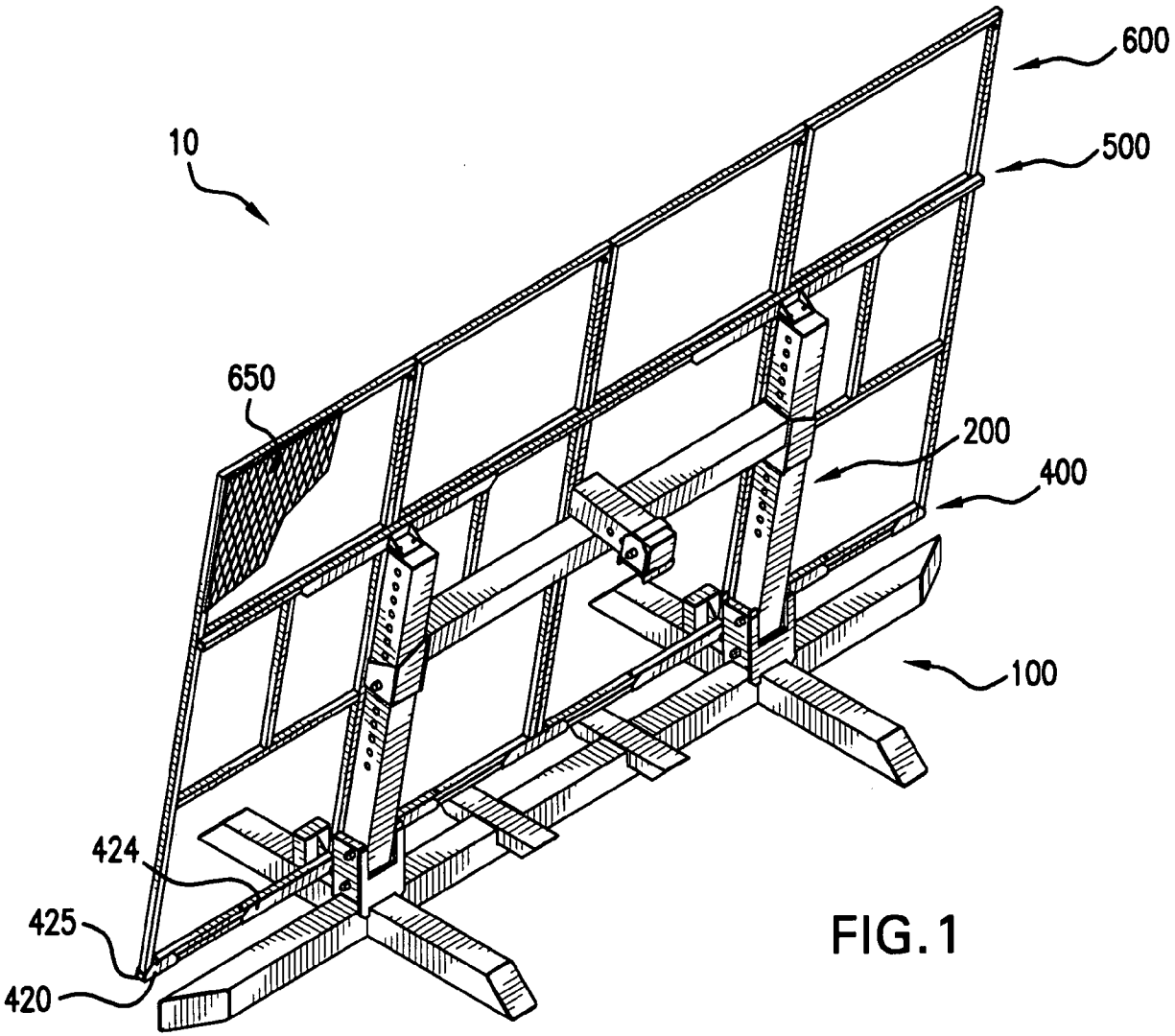
FIG. 1. Front perspective view of the mobile barrier.
Figure 2:
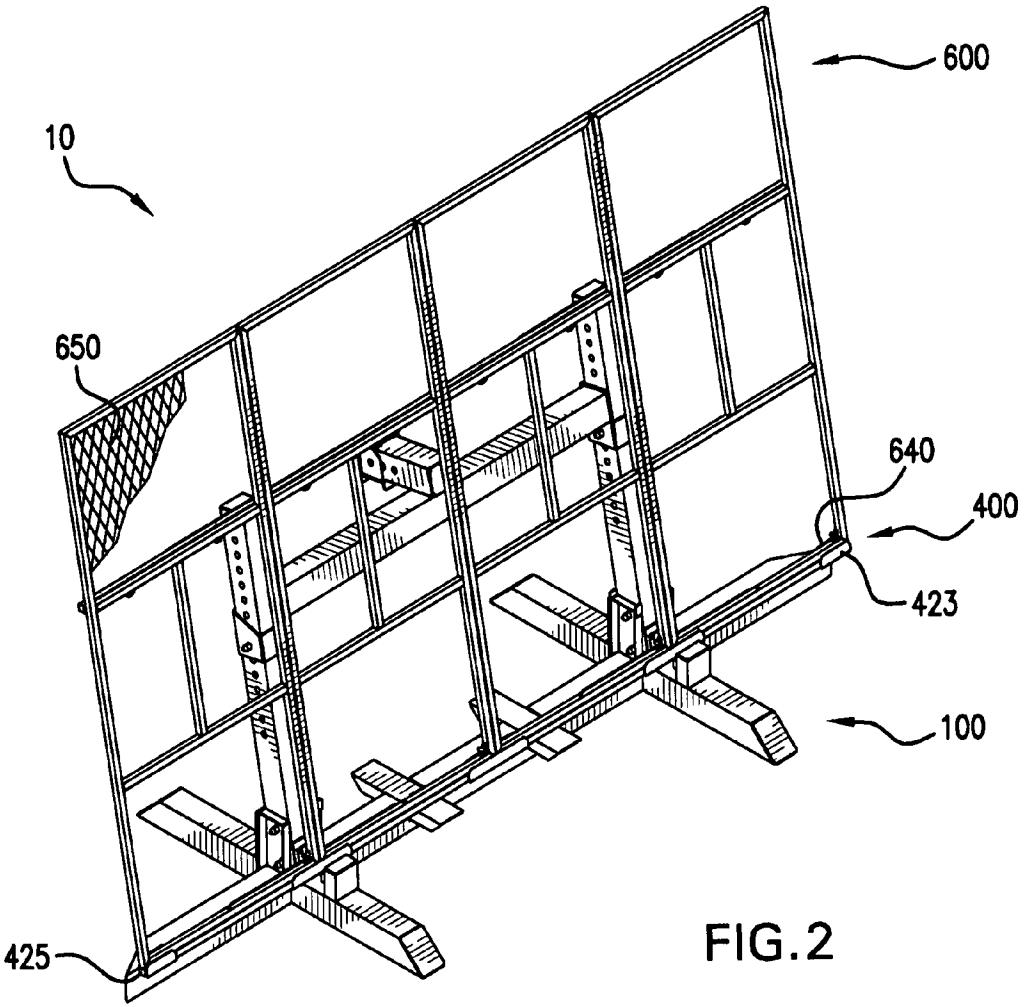
FIG. 2. Rear perspective view of the mobile barrier.

The assembled mobile barrier 10 consists of six discrete weldments of steel, and steel hardware to attach these weldments together. Referring to FIGS. 1 and 2, the weldments that comprise the barrier are base 100, a pair of uprights 200, adjustable boom 300, lower panel support 400, upper panel support 500, and panel 600. Additionally, a misting system 900 may be externally mounted to mobile barrier 10. Mobile barrier 10 is positioned about a work site (active face 810) using heavy machinery 820. This heavy machinery can include, but is not limited to a variety of machines, from a small machine like a Caterpillar D5 bulldozer, to a large machine like a Caterpillar 836 compactor. Machinery 820 are typically equipped with power lifting components such as a blade 821 or fork (not shown).

Base 100 is horizontally oriented and supports uprights 200. Uprights 200 extend generally vertically upward from base 100 and support adjustable boom 300, lower panel support 400, and upper panel support 500. Adjustable boom 300 extends horizontally between the pair of uprights 200, and is vertically adjustable thereon. Lower panel support 400 is a horizontal member which extends between and is secured to the lower end of each upright 200. Upper panel support 500 is a horizontal member which extends between and is secured to the upper end of each upright 200. Lower panel support 400 and upper panel support 500 together support panel 600. Panel 600 is a rigid planar screen sheet which has a longitudinal edge 602 which lies parallel to base 100, and a vertical edge 604 which lies parallel to uprights 200.

Following are descriptions of each of these weldments and the hardware to attach them together. In all portions of the following description, unless otherwise noted, components which are described as tubes are closed and square in section and have a hollow interior space. Components which are described as channel are provided in an open, U-shape section, the U-shape section having a base portion and two leg portions, the leg portions extending normally from opposed ends of the base portion. Further, references to the front of mobile barrier 10 are directed to the side on which machinery 820 interfaces with mobile barrier 10, specifically the side on which adjustable boom 300 is positioned. References to the back of mobile barrier 10 are directed to the side opposite the front, specifically the side on which panel 600 is positioned.

Figure 3:
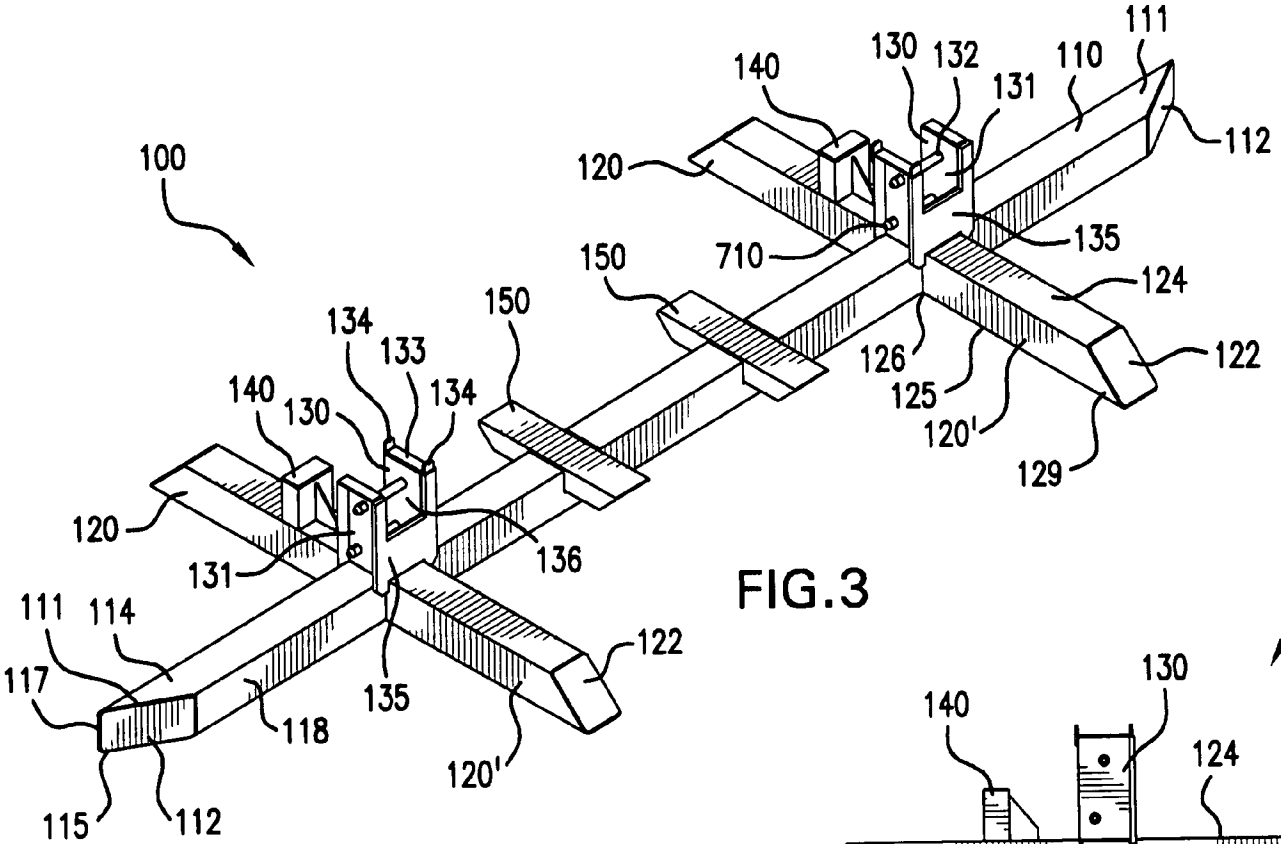
FIG. 3. Front perspective view of the base and upright support bracket.
Figure 4:
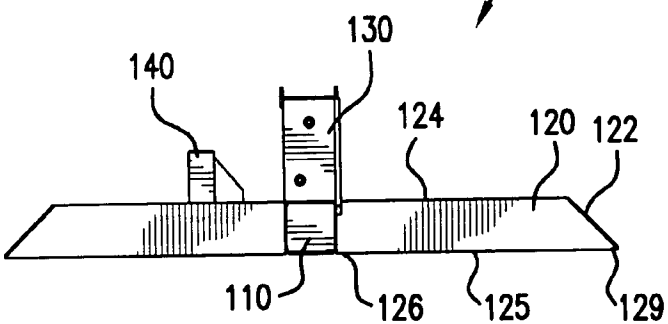
FIG. 4. Side view of the base and upright support bracket.

Base 100 is massive, wide, smooth and stable. Its heavy weight, broad stance, and large surface area make it resistant to sinking and tipping in unstable ground. Referring to FIGS. 1, 3, and 4, base 100 consists of main longitudinal tube 110, transverse foot tubes 120, brackets 130, shipping posts 140, fork pockets 150, all welded together to form the base weldment.

Main longitudinal tube 110 is provided in a length which is at least as long as longitudinal edge 602 of panel 600. Each respective terminal end 111 of main longitudinal tube 110 is angled such that its front surface 118 is shorter in length than its back surface 117. Tapered ends 111 of main tube 110 provide for positioning multiple barriers adjacent to each other with a few inches of overlap, to prevent litter and wind blowing between barriers. Each respective terminal end III is covered by means of main longitudinal tube end plates 112. Main longitudinal tube end plates 112 are welded to terminal ends 111 to seal them and prevent them from sticking in mud and frozen ground.

Transverse foot tubes 120 are secured to main longitudinal tube 110, and are positioned so as to lie transverse to, and in the same plane as, main longitudinal tube 110. Each transverse foot tube has a first foot tube terminal end 126 which is secured to main longitudinal tube 110, and a second foot tube terminal end 129 which is opposed to first foot tube terminal end 126. Second foot tube terminal end 129 is angled such that its upper surface 124 is shorter in length than its lower surface 125. Foot tubes 120 are provided with angled terminal ends 129 to maximize foot length while allowing machinery 820 to come immediately adjacent to mobile barrier 10 without interference. Second foot tube terminal end 129 is covered by means of transverse foot tube end plate 122. End plate 122 prevents transverse foot tube 120 from sticking in mud and frozen ground. A pair of transverse foot tubes 120 are welded to main longitudinal tube 110 such that a first foot tube 120 is secured to the back surface 117, and a second foot tube 120' is secured to the front surface 118 of main longitudinal tube 110, so that they 120, 120' are colinear and oriented transversely to main longitudinal tube 110. A pair of transverse foot tubes are secured to main longitudinal tube 110 adjacent to, but spaced apart from each terminal end 111.

Fork pocket 150 is an elongate sleeve which extends transversely through main longitudinal tube 110 between back surface 117 and front surface 118. Two fork pockets 150 are positioned within main longitudinal tube 110 between respective transverse foot tubes 120 such that they are equidistant from the center of main longitudinal tube 110. These sleeves are generally square channels which are sized to receive the fork 821' of machine 820 therethrough for purposes of lifting and repositioning mobile barrier 10. A lifting lug (not shown) may also be welded to main longitudinal tube 110 to provide additional means of securement to machine 820. Fork pockets 150 and lifting lugs provide for convenient and safe handling of mobile barriers 10 during on-site positioning and shipping.

Shipping posts 140 are short angled blocks which extend upward from the upper surface of back-side foot tubes 120 which provide for self-stacking of collapsed and folded multiple barriers for shipping or storage.

An upright support bracket 130 is used to secure each upright 200 to main longitudinal tube 110 and to maintain upright 200 in a configuration which is generally at a slight angle to the vertical. Upright support bracket 130 also provides a backstop for the bottom of machine blade 821 during lifting and moving. Upright support bracket 130 consists of a pair of opposing side channels 131, top plates 133, stacking tabs 134, and brace channel 135.

Side channels 131 are channel in section and and extend vertically upward from main longitudinal tube 110 at the intersection between main longitudinal tube 110 and transverse foot tube 120. Each side channel 131 is oriented such that the lower edge of its base portion rests on upper surface 114 of main longitudinal tube 110, and such that the lower edges of its leg portions abut the back surface 117 and front surface 118, respectively, of main longitudinal tube 110. The respective base portions of paired side channels 131 are facing each other in a spaced apart relationship.

Brace channel 135 is channel in section, and shorter in length than side channels 131. Brace channel 135 is secured between the paired side channels 131 by welding the base portion of each respective side channel 131 to opposed leg portions of brace channel 135. The lower edge of the base portion of brace channel 135 is welded to main longitudinal tube 110 adjacent to its front surface 118. Because brace channel 135 is shorter in length than side channels 131, an opening 136 is provided between the upper portions of side channels 131. Uprights 200 extend through opening 136 as a result of their slightly angled orientation relative to the vertical. Brace channel 135 is relatively heavy in construction because it is the contact point, or wear surface, for the lower edge of blade 821 of machine 820 when machine 820 is lifting and transporting mobile barrier 10. Brace channel 135 also provides additional rigidity to upright support brackets 130.

Pin holes 132 are formed in the base portion of each respective side channel 131 such that they are horizontally aligned. Pin holes 132, when aligned with lower pin holes 212 of upright 200, receive wrist pins 710 therein to hold upright 200 in place in either erected or folded configuration.

Top plates 133 and stacking tabs 134 are plate welded to the upper edges of side channels 131. Top plates 133 add additional structural stiffness to side channel 131. Stacking tabs 134 are secured to the upper edge of the leg portion of side channel 131, and allows easy stacking of multiple barriers when mobile barrier 10 is in folded configuration.

Uprights 200, together with base 100 and boom 300, provide for easily lifting, moving and positioning of mobile barrier 10 as site and wind conditions change. In the preferred embodiment, each mobile barrier 10 is provided with two uprights 200. Referring to FIGS. 1,2,5,6,12 and 13, each upright 200 consist of tube 210, bottom plate 220, back plate 230, and top plate 250, all welded together to form uprights 200. Uprights 200 support adjustable boom 300, lower panel support 400, and upper panel support 500, and maintain them in a position which is spaced apart from and overlies base 100.

Upright tube 210 is an elongate square tube extending upward from base 130 in an orientation which is generally at a slight angle to the vertical. In the preferred embodiment, this angle is 10 degrees. For purposes of litter control, this angle helps panel 600 shed litter. For example, when mobile barrier 10 is used for litter control, mobile barrier 10 is positioned so that uprights 200 lean into the wind, so that when windspeed drops, any litter trapped upon mobile barrier 10 drops to the ground. For purposes of wind control, panel 600 is positioned to lean downwind. This position reduces the turbulence created by a vertical (oriented at an angle of 0 degrees) panel 600, and helps to direct wind up and over the barrier. Additionally, providing a slight angle to uprights 200 is a convenient way to extend the adjustable boom 300 over the upper edge of a blade 821 of moving machinery 820, noting that in such blades 821, the bottom of the blade is forward of the top of the blade.

Upright tube 210 has an upper end 260, a lower end 261, an back face 262, a front face 263 which is opposed to back face 262, and opposing lateral faces 264 which extend between back face 262 and front face 263.

Pin holes 211, 212 are horizontally aligned through holes extending through lateral faces 264 of upright tube 210. At least two lower pin holes 212 are provided to position and secure upright 200 to bracket 130 by alignment with pin holes 132 and securement with pins 710. Multiple upper pin holes 211 provide for adjustment of the height of boom 300. Upper pin holes 211, when aligned with pin holes 333 of adjustable boom 300, receive wrist pins 710 therein to hold adjustable boom 300 at the desired vertical position.

Back plate 230 is a generally square plate welded to lower end 261 of back face 262 of tube 210 to provide for mounting of lower panel support 400 to upright 200. Tapped holes 231 are provided in back plate 230. Tapped holes 231, when aligned with slotted holes 412 of plate 411 of lower panel support 400, receive bolts 720 therein to hold lower panel support 400 at the desired horizontal position relative to the lower end of upright 200.

A bracket stop may be included to prevent adjustable boom 300 from sliding too far down upright 200 by welding a short plate welded to front face 264 of tube 210.

Top plate 250 is generally square plate welded to top of tube 210 to close the upper end 260 of upright 200 and to provide for mounting of upper panel support 500 to the upper end 260 of upright 200. Tapped holes 251 are provided in top plate 250. Tapped holes 251, when aligned with slotted holes 512 of plate 511 of upper panel support 500, receive bolts 720 therein to hold upper panel support 500 at the desired horizontal position relative to the upper end 260 of upright 200.

Bottom plate 220 is a generally square plate welded to bottom of tube 210. Drain holes (not shown) are provided at the lower end 261 of upright 200 by chamfering the corners of bottom plate 220. Drain holes provide for drainage of water that may enter upright 220 through pin holes 211, 212. Bottom plate 220 also provides additional rigidity to upright 200.

Figure 5:
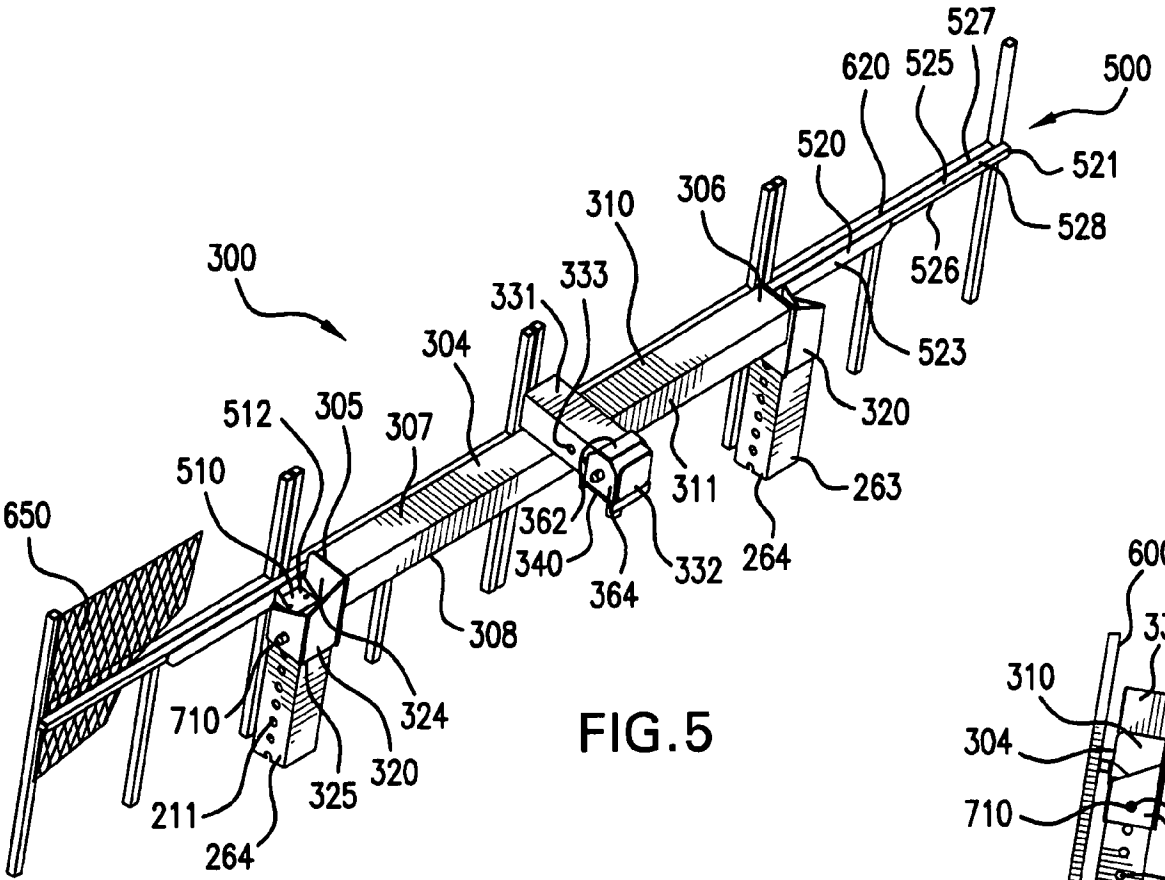
FIG. 5. Partial front perspective view of the mobile barrier illusrating the adjustable boom and upper panel support mounted to the upper end of the uprights.
Figure 6:
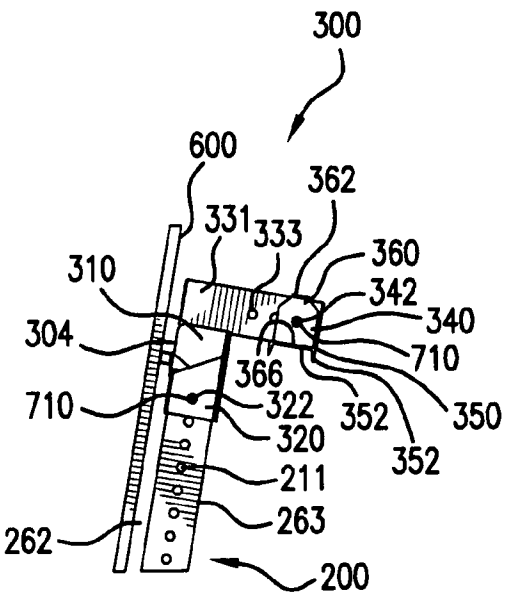
FIG. 6. Side view of FIG. 5.

Adjustable Boom 300 provides a means releasably connecting mobile barrier 10 to machinery 820 for purposes of lifting and repositioning mobile barrier. Adjustable boom 300 is vertically adjustable along uprights 200 to accommodate the differing heights of lifting components 821 of machinery 820. Referring to FIGS. 5 and 6, adjustable boom 300 consists of lifting tube 310, lifting tube sleeves 320, bale tube 331, and blade hook 340.

Lifting tube 310 is an elongate, horizontally oriented tube which extends between, and is secured to, uprights 200. Lifting tube 310 has a first end 305, a second end 306 which is opposed to first end 305 and separated from it by mid portion 304. Lifting tube 310 has an upper surface 307, and a lower surface 308 which is opposed to the upper surface and separated from it by the respective front 311 and back 309 surfaces.

A lifting tube sleeve 320 is provided at each respective end 305, 306 of lifting tube 310. Each lifting tube sleeve 320 is a short tube of square cross section which is sized and oriented to fittingly surround upright 200, and receive upright 200 through its hollow interior. Lifting sleeve 320 is provided in a length such that its upper edge 324 lies flush with upper surface 307 of lifting tube 310, and such that its lower edge 325 lies below lower surface 308 of lifting tube 310.

Pin holes 322 are horizontally aligned through holes extending through lateral faces 323 of lifting tube sleeve 320 at a position below lifting tube 310. Pin holes 322 are provided to position and secure lifting tube 310 to upright 200 by alignment with upper pin holes 211 of upright 200 and securement with pins 710. Multiple upper pin holes 211 provide for adjustment of the vertical position, or elevation, of adjustable boom 300.

Bale tube 331 is an elongate tube which fixed to upper surface 307 of lifting tube 310 midway between uprights 200. Bale tube 331 lies transversely to lifting tube 310 such that it extends perpendicularly relative to front surface 311 of lifting tube 310. Multiple pin holes 333 provide for adjustment of the transverse position of collar 360 of blade hook 340 along bale tube 331. Pin holes 333, when aligned with pin holes 342 of collar 360, receive wrist pins 710 therein to hold collar 360 at the desired position along bale tube 331. End plate 332 seals the terminal end of bale tube 331.

Figure 19:
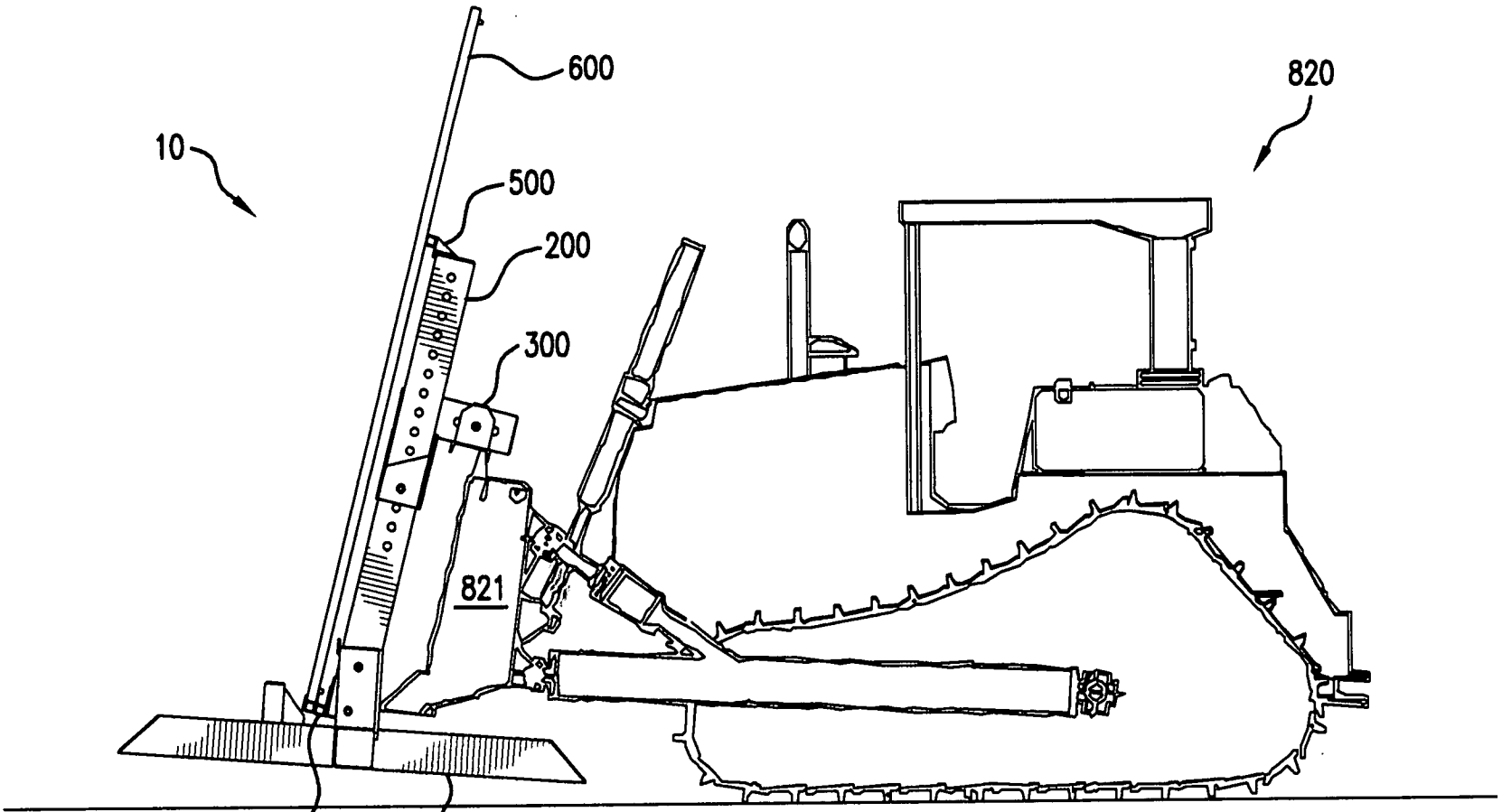
FIG. 19. A mobile barrier being lifted by the blade of a bulldozer, illustrating the position of the top edge of the bulldozer blade within the hook portion of the adjustable lifting boom, and the position of the lower edge of the bulldozer blade against the brace channel of the upright support bracket FIG. 20. Multiple barriers in use around an active face, illustrating barriers used for wind control upwind of the active face, and barriers used for litter control downwind of the active face.
Figure 20:
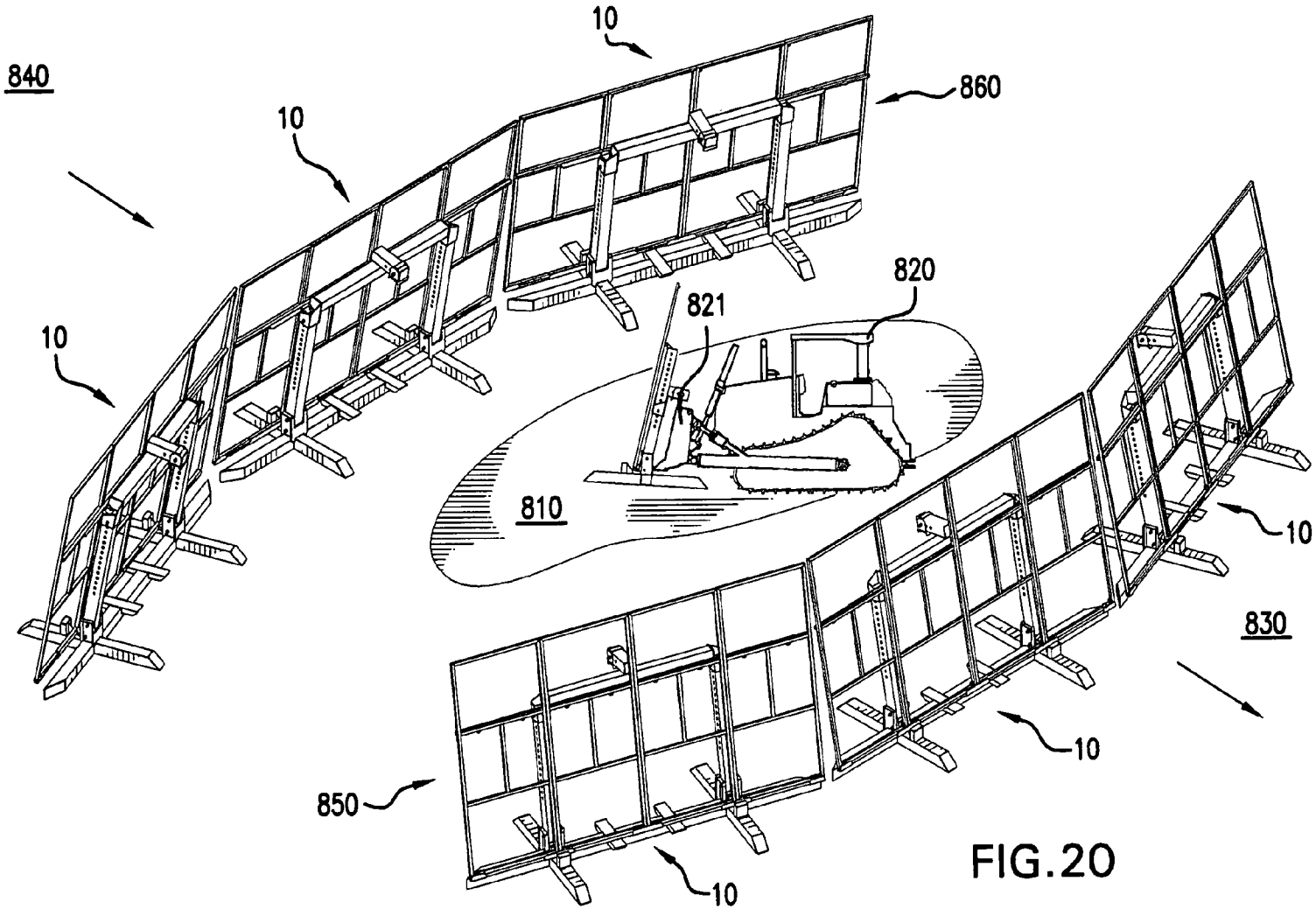

Blade hook 340 consists of collar 360 and a hook 350. Collar 360 is a short tube of square cross section which is sized to fittingly surround bale tube 331 and receive bale tube 331 through its hollow interior. Collar 360 has an upper surface 362, lower surface 366 which is opposed to upper surface 362 and separated from it by lateral sides 364. Hook 350 is channel in section. Base portion 352 of hook 350 is secured to lower surface 366 of collar 360 so that leg portions 354 of hook 350 are oriented downward and aligned such that they extend between respective lateral sides 364 of collar 360. A pin hole 342 is provided in horizontal alignment in each lateral side 364 of collar 360. Pin holes 342 are provided to allow adjustable positioning along and securement to bale tube 331 of collar 360 by alignment with pin holes 333 of bale tube 331 and securement with pins 710. This adjustment of collar 360 along bale tube 331 allows compensation for machine blades 821 of various sizes and angles. The upper edge of blade 821 of machinery 820 is received within hook 350 when mobile barrier is being lifted and repositioned using machinery 820 (FIGS. 19 and 20).

Figure 8:
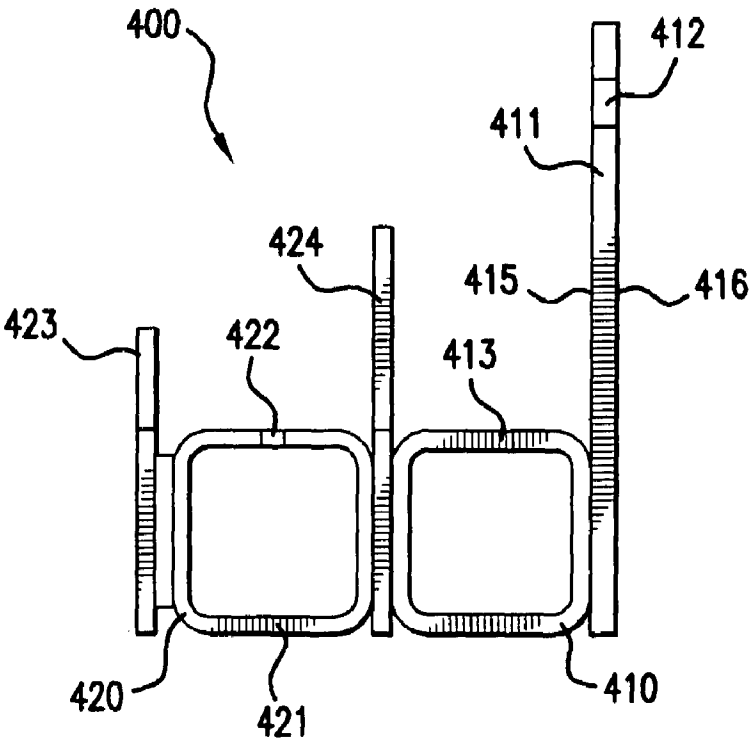
FIG. 8. Side view of lower panel support.

Lower Panel Support 400 supports the lower horizontal edge of panel 600, is provided in a length which is at least as long as longitudinal edge 602 of panel 600, and is mounted in a horizontal orientation to lower end 261 of upright 200. Referring to FIGS. 1, 2, and 8, lower panel support 400 consists of brackets 410 and lower panel support member 420.

Lower panel support member 420 consists of an elongate tube 421, front support plates 424, back support plates 423, and lateral end support plates 425. Tube 421 provides most of the support to panel 600. Lower longitudinal edge 601 of panel 600 is prevented translation relative to tube 421 by employing front 424 and back 423 suppport plates, as well as lateral end support plates 425. Front 424 and back 423 suppport plates are short flat plates welded to the respective front and back faces of tube 421 at spaced intervals. Front 424, back 423, and lateral end support plates 425 are provided in a height which is greater than the height of tube 421, and are fixed to the respective front, back, and terminal end faces of tube 421 such that they extend above the upper surface of tube 421, forming a recessed slot into which the lower longitudinal edge 601 of panel 600 resides during use, trapping panel 600 thereon. These plates 423, 424, 425 also provide rigidity to lower panel support 400. Tapped holes 422 receive bolts which pass through and secure lower longitudinal edge 602 of panel 600 to tube 421.

Lower panel support 400 mounts to back plate 230 of uprights 200 using brackets 410. Brackets 410 consist of vertically oriented rectangular plate 411 and spacer tube 413. In use, front face 416 of plate 411 confronts and overlies back plate 230. Spacer tube 413 is sandwiched between and secured to the lower edges of both the back face 415 of plate 411, and to front plate 424. Slotted holes 412, located adjacent the upper edge of plate 411, provide compensation for tolerance during assembly of bracket 410 to back plate 230 of upright 200.

Figure 7:
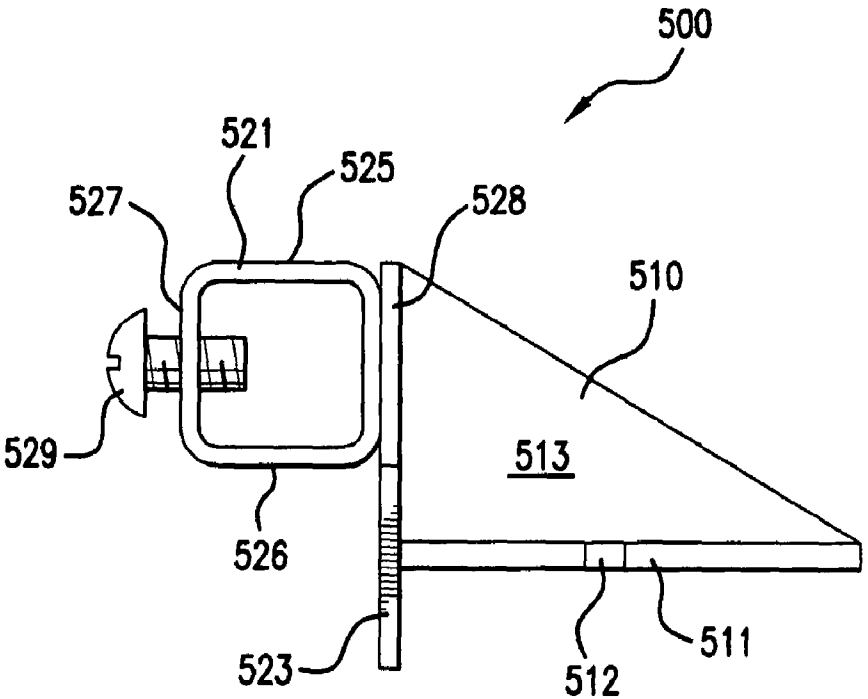
FIG. 7. Side view of upper panel support.

Upper Panel Support 500 supports the upper portion of panel 600 and provides a means to secure cross tubes 620 of panel 600 to upper end 260 of upright 200. An elongate tube, upper panel support 500 is provided in a length which is at least as long as longitudinal edge 602 of panel 600, and is mounted in a horizontal orientation to upper end 260 of upright 200. Referring to FIGS. 5 and 7, upper panel support 500 consists of brackets 510 and upper panel support member 520.

Upper panel support member 520 consists of elongate tube 521, web plates 523, and studs 529. Tube 521 has an upper surface 525, a lower surface 526 which is opposed to upper surface 525, a front surface 528, and a back surface 527 which is opposed to front surface 528 and spaced apart from it by respective lower 526 and upper 525 surfaces. Back surface 527 of tube 521 lies parallel to and confronts the front-facing surface of cross tubes 620.

Figure 18:
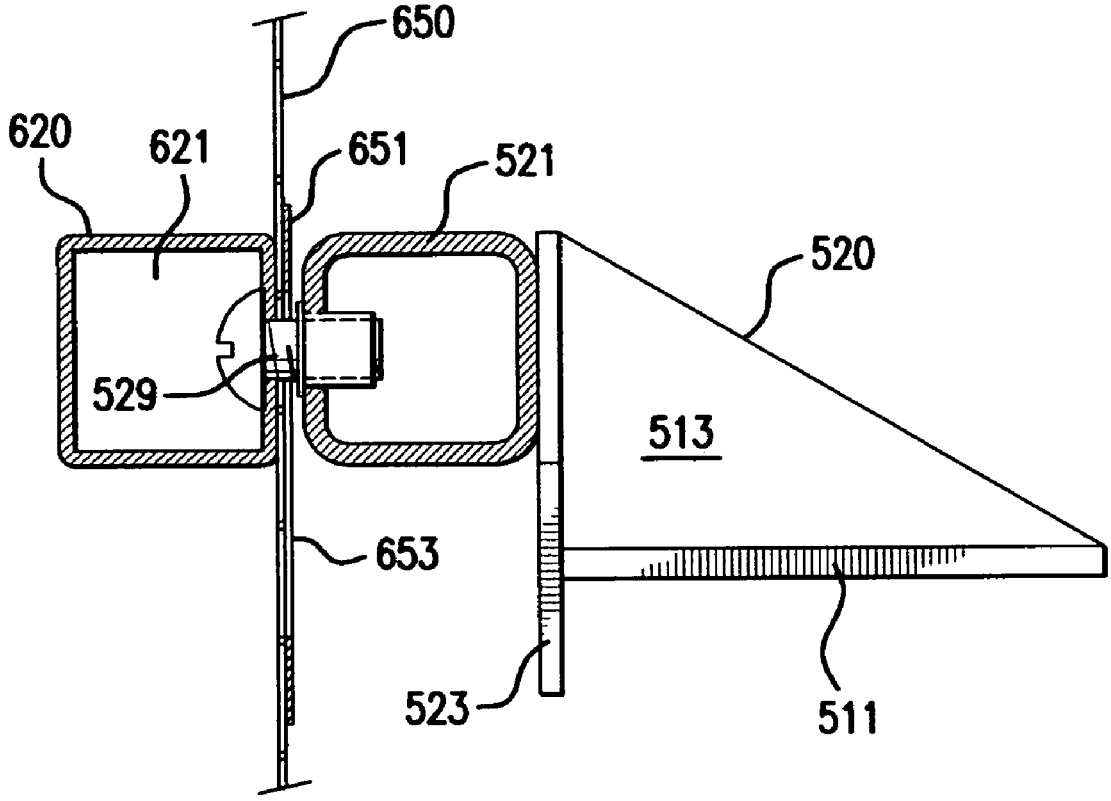
FIG. 18. Partial side sectional view of the upper panel support member illustrating the stud of the upper panel support positioned within a slot formed in the cross tube of the panel.

Referring now to FIG. 18, studs 529 extend outwardly from back surface 527 of tube 521, and in use pass through an opening 653 in screen 650 and are received within stud slots 621 formed in the lower surface of cross tube 620.

Opening 653 in screen 650 is reinforced by welding a flat, circular plate around the lower peripheral edge of opening 653. This reinforcement, or "finder", plate 651, allows for easy positioning of screen 650 over stud 525 during attachment. Thus, the upper portion of panel 600 is secured to and supported by upper panel support member 520 by being hung upon studs 529. Additionally, this design locks panel 600 to upper panel support member 520 without the use of tools or adjustment.

Brackets 510 consist of a horizontally oriented generally rectangular plate 511, a back edge of plate 511 being secured to a vertically oriented web plate 523. Bracket 510 is reinforced using a triangular gusset 513 between plate 511 and web plate 523. Tube 521 is secured to the upper portion of web plates 523. Slotted holes 512 in plate 511 receive bolts which secure brackets 510, and thus upper panel support 500, to top plate 250 of upright 200. Web plates 523 provide rigidity to upper panel support 500.

Figure 9:
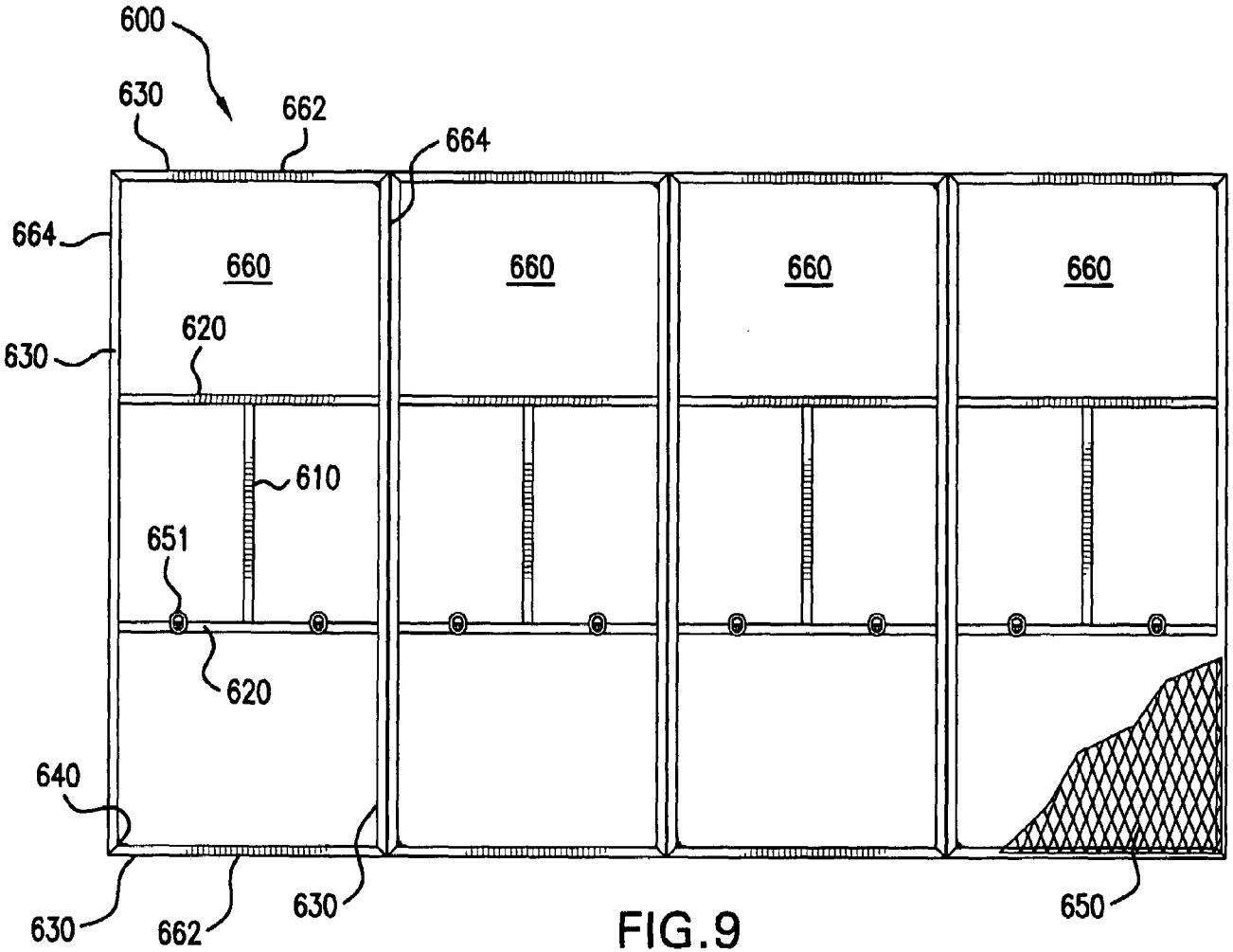
FIG. 9. Front view of panel illustrating four sub panels and partial overlay of open screen.

Referring to FIGS. 1,2, and 9, panel 600 is an assembly of multiple rectangular sub panels 660. Multiple sub panels are joined serially at their respective lateral vertical edges 664 to form a single large planar panel 600. In the preferred embodiment, panel 600 is formed of four sub panels 660 as illustrated in the figures. However, it is well within the scope of the invention to provide panel 600 having more or fewer sub panels 660 in order to accommodate the requirements of a specific application.

Each sub panel 660 is formed of perimeter tubes 630, lifting tube 610, cross tubes 620, stacking tabs 640, and screen 650. Perimeter tubes 630 consist of four sections of tube which provide a rectangular outer frame having opposed long vertical edges 664, and opposed short horizontal edges 662. Opposing vertical edges 664 are bridged using at least two horizontally oriented cross tubes 620. A lifting tube extends vertically between each adjacent cross tube 620, and is positioned mid way between the vertical edges 664. Lifting tube 610 is heavier than cross tubes 620 and cross tubes 620 are heavier than perimeter tubes 630. Lifting tube 610 provides for lifting and handling multiple panels 600 with a forklift without damage to delicate panels 600.

Cross tubes 620 transfer lifting load to perimeter tubes 630. In addition, the lower surface of cross tube 620 have t-shaped stud slots 621 formed therein which are sized and shaped to receive the studs 529 of upper panel support 500 therein (FIG. 18).

Figure 10:
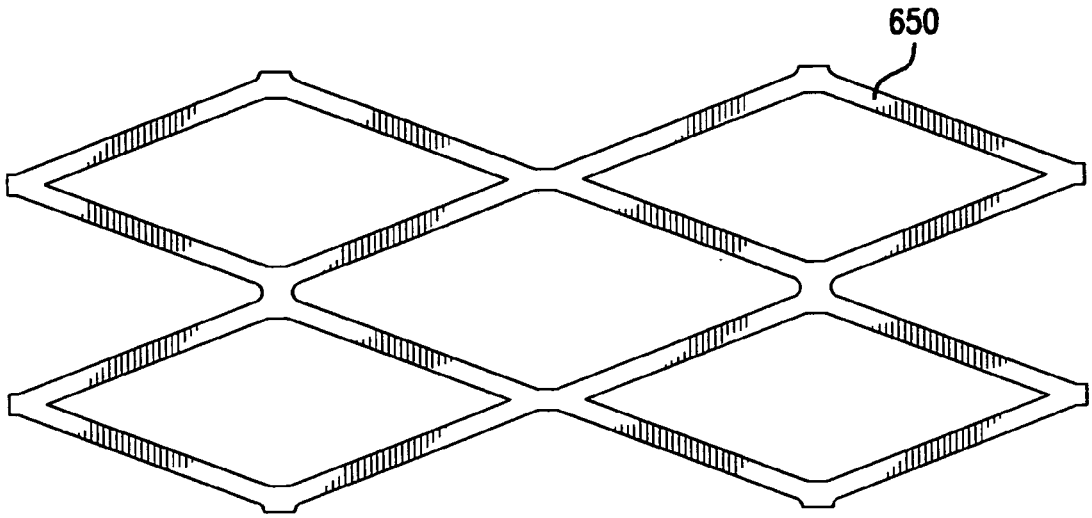
FIG. 10. Partial detail view of open screen.

Lifting tubes 610, cross tubes 620, and perimeter tubes 630 provide a very strong, lightweight frame on which to mount relatively fragile screen 650. Screen 650 is welded to cross tubes 620 and perimeter tubes 630. The panels 600 are planar and free of catches that would tend to trap litter against the panels. The panels 600 are detachable and interchangeable, so a barrier 10 may be used with panels having generally "closed" screen downwind to control wind, or used with panels having generally "open" screen back to control litter. In the preferred emobidment, open screen 650 (FIG. 10), used to control litter, is 1.5"×13 ga. flattened expanded steel with an open area of approximately 83 percent. Also in the preferred embodiment, closed screen 650' (FIG. 11), used to control wind, is 16-gage perforated steel with an open area of approximately 50 percent, preferrably in the range of 40 to 60 percent.

Misting System

Figure 16:
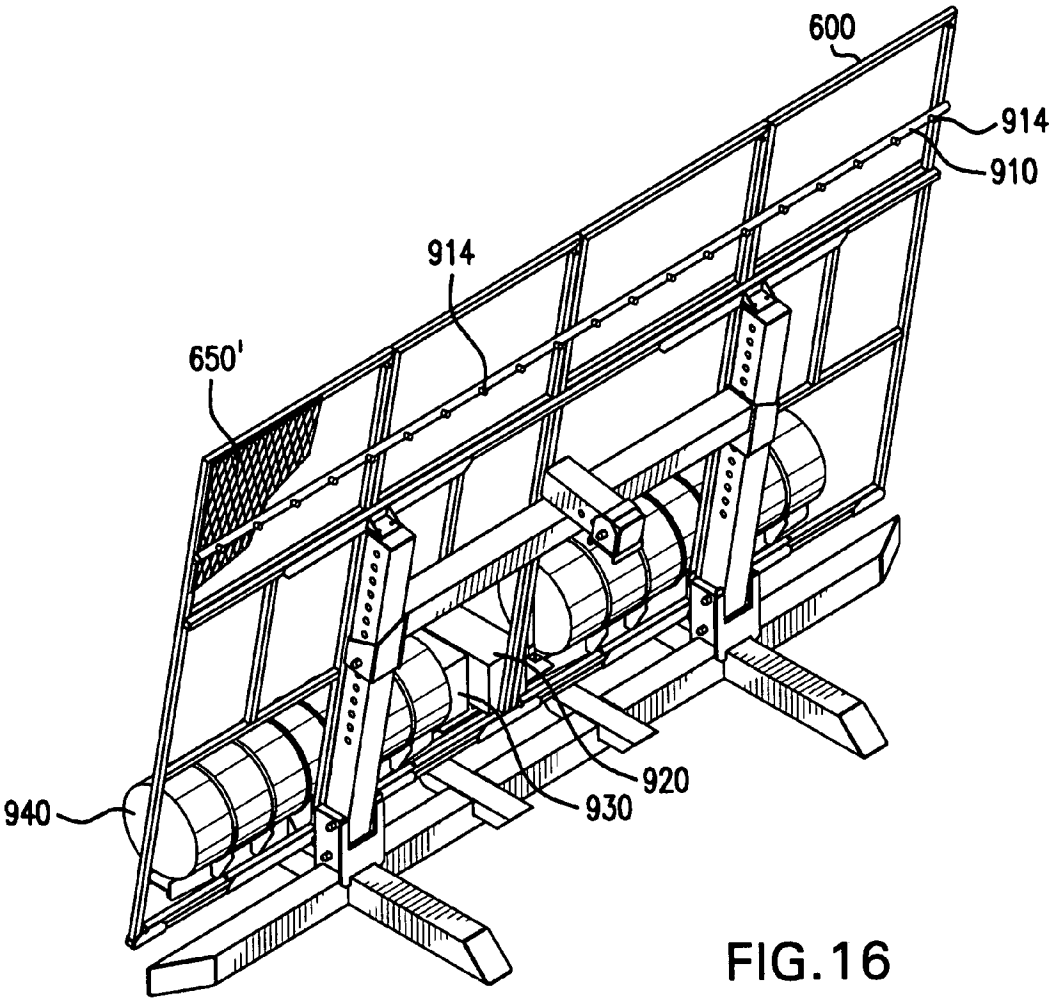
FIG. 16. Front perspective view of the mobile barrier with the misting system mounted thereon, illustrating the spray bar mounted on the front face of the panel.
Figure 17:
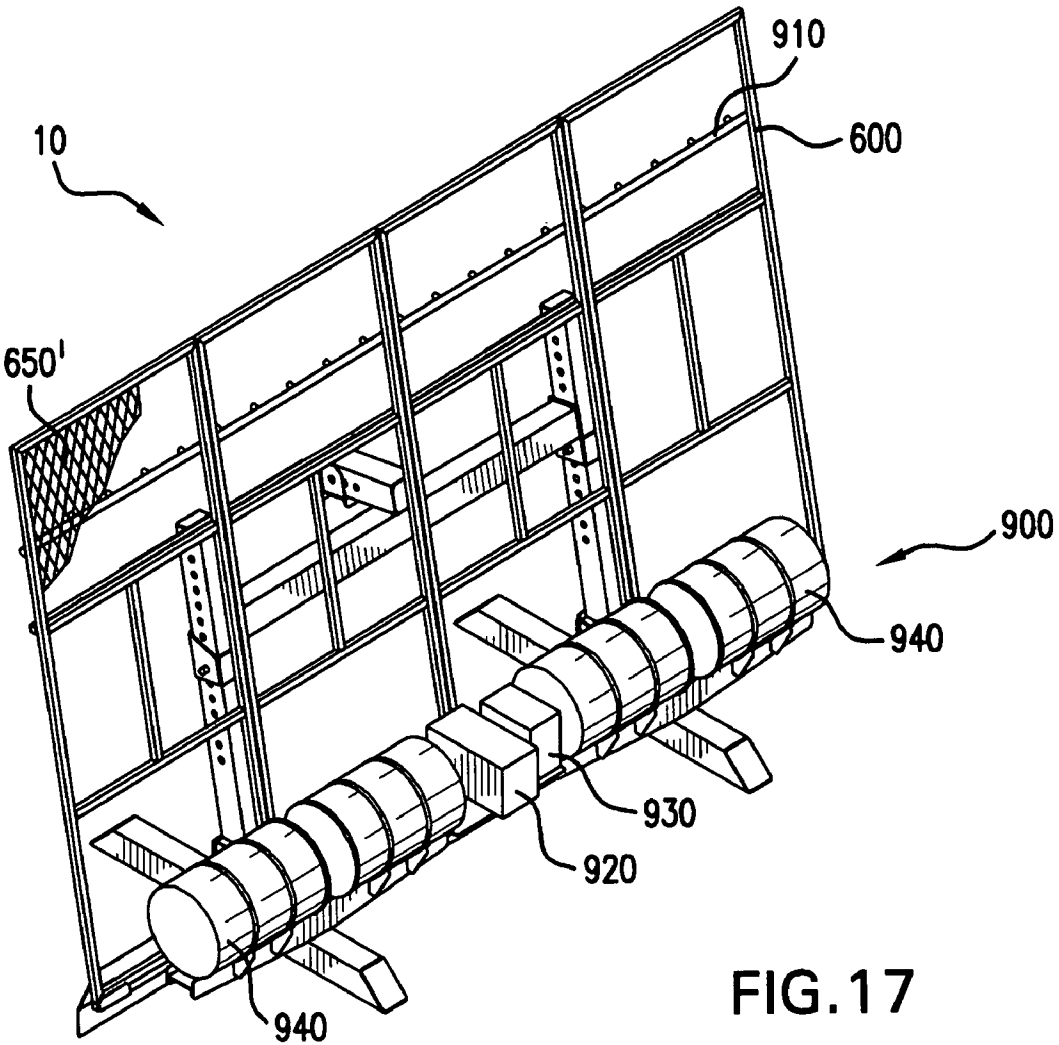
FIG. 17. Rear perspective view of the mobile barrier with the misting system mounted thereon, illustrating the water tanks, pump, and power unit mounted on the base.

Mobile barrier 10 may be provided with a misting system 900 (FIGS. 16 and 17) for use in controlling the suspension and transport of airborne contaminants from earthwork, landfill, and surface mining operations. Misting system 900 is externally mounted to mobile barrier 10, and includes a power unit 930, fluid tanks 940, fluid pump 920, spray bars 910, and interchangeable nozzles 914. Base 100 of mobile barrier 10 provides a rugged platform for the tanks 940, power unit 930, pumps 920, and associated controls and plumbing so that the misting system is mobile. In the preferred embodiment, when mobile barrier 10 is provided with misting system 900, it is used with panels 600 having closed screen. This allows wind reduction to be combined with the misting action for more effective contaminant control.

The power unit 930 provides mechanical power to the pump 920. Power units are conventional and well known in the art. In the preferred embodiment, power unit 930 includes a diesel motor with an electric start, such as the commercially available Hatz 5-hp 1B40 industrial diesel motor. Diesel power is preferred because it has better fire safety than gas, is more efficient because it consumes less fuel, and is the fuel of choice for that machines that will be used with the misting system. Additionally, the diesel motor is more amenable to automation and control because it is easier to provide remotely controlled start, stop, and throttle. It is understood, however, that other motors may be substituted to suit the requirements of a specific application. Pumps 920 are also conventional and well known in the art. In the preferred embodiment pump 920 is a triplex progressive cavity pump capable of producing pressures of at least 2000 psi, such as the GP brand pump for a pressure washer. It is understood, however, that other pumps may be substituted to suit the requirements of a specific application. Pump 920 is directly coupled to power unit 930.

Tanks 940 provide water for the misting system. Tanks 940 are selected to provide optimum water capacity. High water capacity is important because it increases the autonomy time of the misting system 900. However the high water capacity is balanced with the load carrying capability of the mobile barrier. Thus, tanks 940 provide the optimum capacity, but also partition the water, as in the case of fuel tanks for aircraft, for example. Partitioning may be accomplished by using plural, serially connected tanks 940 as shown in the figures, or by other conventional means. A series of check valves are provided between tanks 940 to prevent water from flowing from one tank to the other. This prevents shifting of the water on uneven terrain that would produce an unbalanced load that is difficult to handle.

Plumbing allows fluid flow between tanks 940, pump 920, and spray bars 910, and consists of low pressure piping, check valves, an inlet screen to protect the pump, high pressure piping, a pressure regulator, a relief valve, gages, and all other necessary valves and fittings.

Spray bars 910 are a manifold of machined nylon pipe 912 that provide water pressure to plural, spaced apart nozzles 914. Spray bars 910 are built to withstand pressures up to 2000 psi. Nozzles 914 are selectively removable and interchangeable to provide the required water droplet size distribution. In the preferred embodiment, nozzles 914 are spaced one nozzle per foot along spray bar 910.

Many misting sytems are left on, even when they are not needed, because startup and shutdown is an inconvenience to the operators. This practice wastes water and creates a mess. Misting system 900 features controls that address this problem. The controls allow an operator to remotely start, stop, and vary the output of the misting system from the cab of the machine. Therefore the appropriate mist can be dispensed as needs change. This reduces water and fuel consumption and increases autonomy time because it reduces service interval to fill water and fuel.

A wind speed and direction indicator may be mounted on top of panels 600. The preferred indicator consists of a wind vane, pinwheel, and gimball mount. This wind speed and direction indicator would provide visual indication of relative wind speed and direction in the area of the barrier. With this information the operator can position the barrier in the optimum location. Use of a gimbal mount provides vertical orientation of axis when barrier 10 is positioned on uneven terrain.

Approximate dimensions for the components used to form the preferred embodiment of my invention will now be provided. It is understood, however, that these approximate dimensions are provided for purposes of illustration of scale and construction of the invention, and that these approximate dimensions may be altered to accommodate the requirements of a specific application. Specific fabrication and welding methods, and clearances, dimensions, and tolerances are not included in this specification because they are within ordinary skills in the art of steel fabrication.

In the preferred embodiment, mobile barrier 10 is 8 feet deep, 20 feet long, and approximately 13 feet tall. Main longitudinal tube 110 is formed of an 8"×8"×1/4" tube of 20 feet in length, and main longitudinal tube end plates 112 are formed from 1/4" plate welded to terminal ends 111. Each transverse foot tube 120, 120' are 8"×8"×1/4" tube of approximately 4 feet in length, providing an overall transverse footprint of approximately 8 feet. Foot tube end plates 122 are 1/4" plate welded to ends of tubes 121.

Side channels 131 of upright support brackets 130 are 8"×13.75# channel. Top plates 133 and stacking tabs 134 are 1/4" plate welded to side channels 131. Front plate 135 is 8"×13.75# channel welded between side channels 131.

As regards uprights 200, upright tube 210 is 8"×8"×1/4" tube of approximately 8 feet in length. In the preferred emobdiment two uprights 200 are provided on mobile barrier 10, spaced on center approximately 10 feet apart.

Adjustable boom 300 has an overall length of approximately 10 feet. Lifting tube 310 is formed of an 8"×8"×1/4" tube, and lifting tube sleeves are formed of 3/8" steel plate. Lifting bale 330 is welded to the front center of lifting tube 331 and consists of 8"×8"×1/4"×16" tube.

As regards lower 400 and upper 500 panel supports, respective support tubes 421, 521 and spacer tube 521 are formed of is 2"×2"×1/4" tube.

Figure 11:
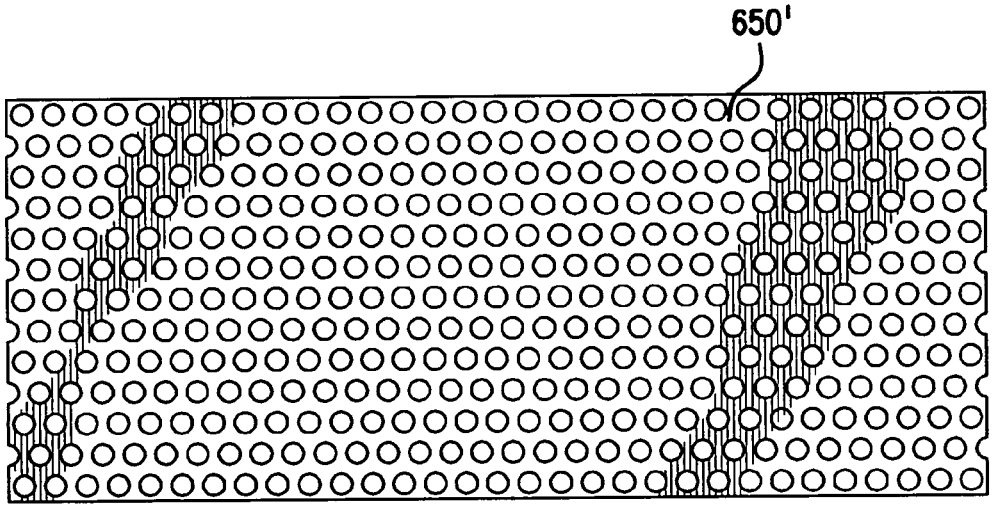
FIG. 11. Partial detal view of closed screen.
Figure 12:
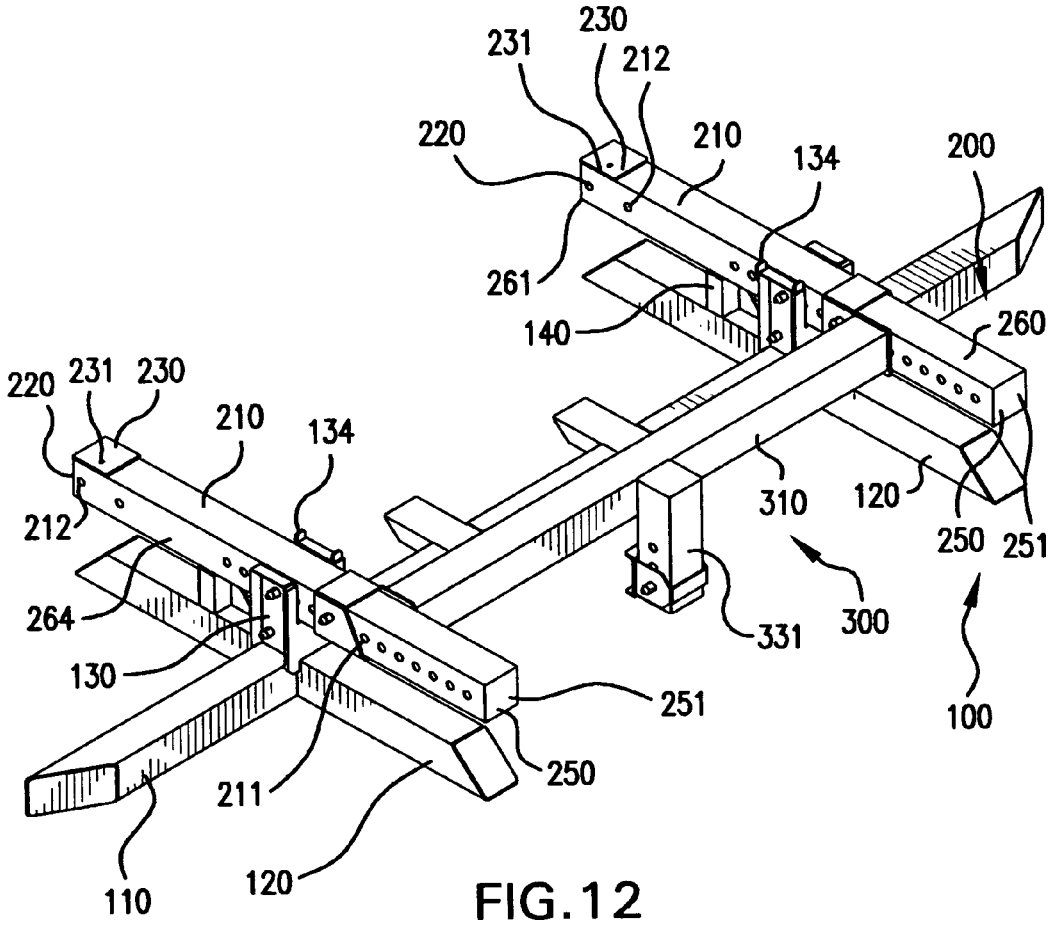
FIG. 12. Front perspective view of a single mobile barrier in folded configuration.
Figure 13:
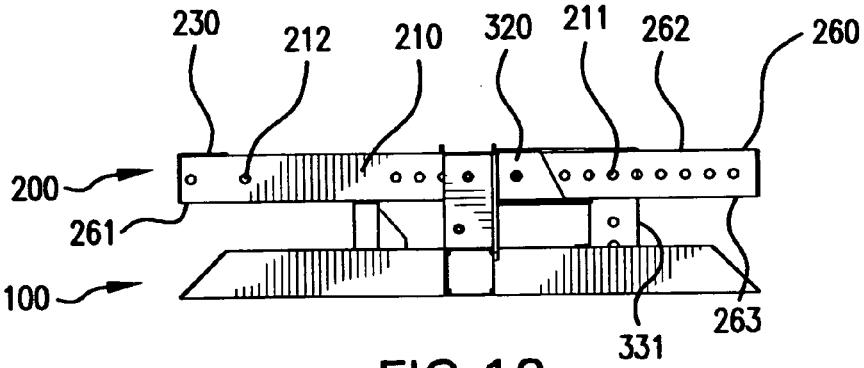
FIG. 13. Side view of FIG. 12.

As regards panels 600, lifting tube 610, cross tubes 620, and perimeter tubes 630 are all 2"×2" tube, having 1/4", 1/8", and 1/16" thicknesses, respectively. In the preferred embodiment, panels 600 have overall dimension of 5'×12'×2". Screen 650 is either open, having 1.5"×13 ga. expanded flattened steel of 83 percent open area (FIG. 10), or closed, having 16 ga. perforated steel with approximately 50 percent open area (FIG. 11).

Figure 14:
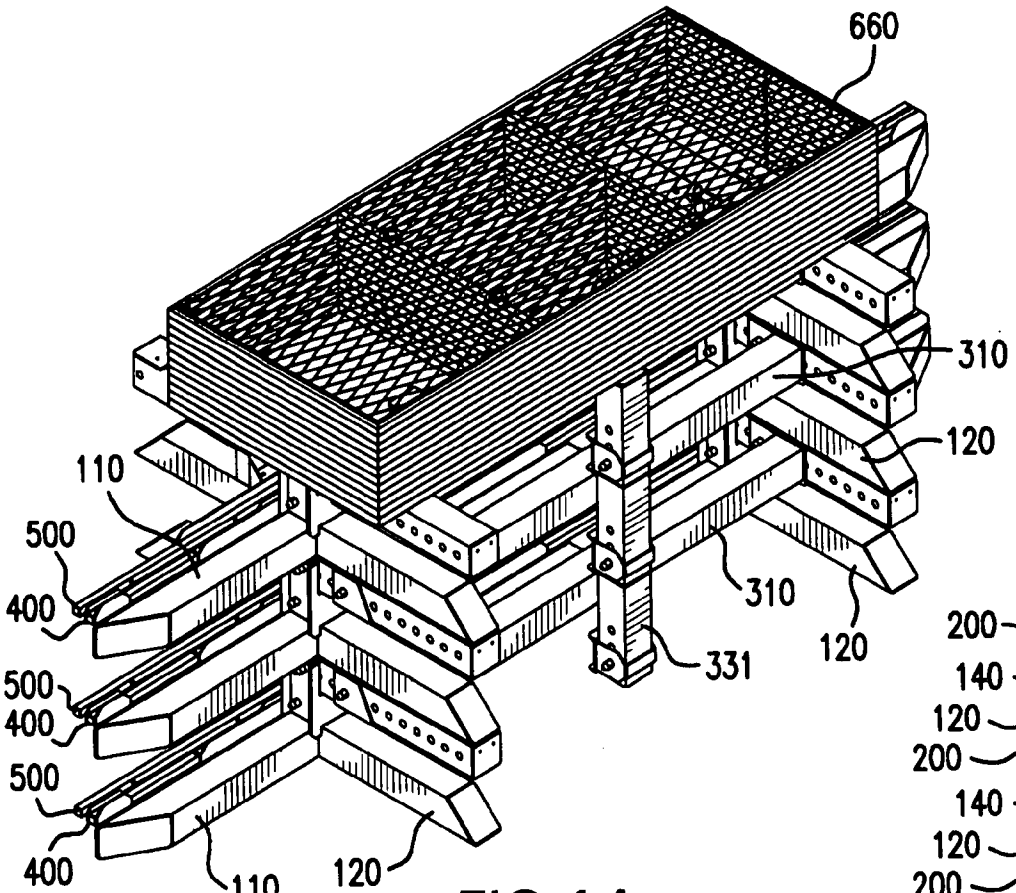
FIG. 14. Front perspective view of three mobile barriers in folded and stacked configuration.
Figure 15:
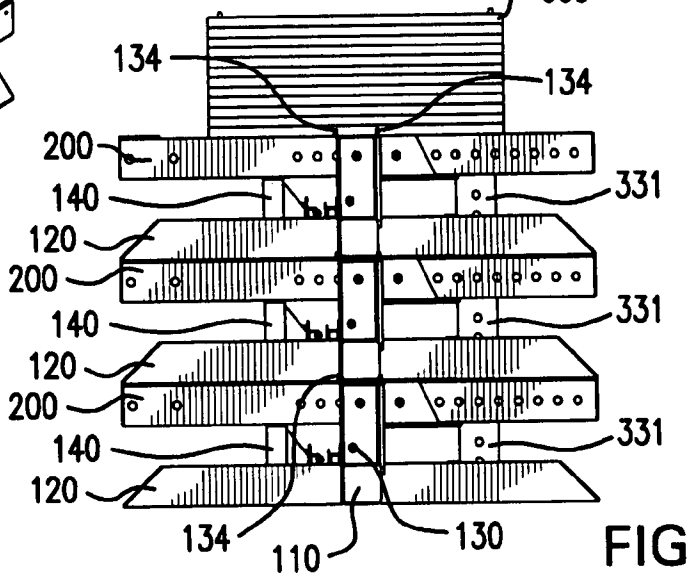
FIG. 15. Side view of FIG. 14.

Referring to FIGS. 14 and 15, the mobile barrier folds very compactly and multiple barriers stack securely for efficient and safe shipping. To accomplish this, panels 600 and panel supports 400, 500 are dis-assembled, and the uprights 200 and adjustable boom 300 are folded relative to base 100. Panel supports 400, 500 are self locking and stowing such that no tying-down or taping is required to keep them stacked with the folded unit. The aforementioned stacking tabs 134 on upright support brackets 130 and shipping posts 140 on foot tubes 120 provide for stacking with no blocking, bracing, cribbing. These provisions allow for up to six units to be shipped on a standard 8'×40' flatbed trailer.

FIG. 20 shows barrier 10 as it is being moved around active face 810 of a site with blade 821 of bulldozer 820. The top of blade 821 fits inside hook 350 of adjustable boom 300. The bottom of blade 821 rests against front plate 135 of base brackets 130 of base 100. This configuration provides for securely lifting and moving the barrier around the active face.

In FIG. 20 wind direction is indicated by an arrow to be flowing from the upper left to lower right. Several mobile barriers 10 are placed downwind 830 of an active face 810 using panels 600 which would be equipped with open screen 650 to prevent litter from escaping from active face 810. The bulldozer 820 places the barriers 10 immediately downwind 830, and at the actual edge, of the active face 810 forming a downwind barrier 850. The barrier 850 stops the litter as the wind passes through. When the wind subsides, the litter falls down to the base of the barrier and is still within active face 810.

FIG. 20 also shows several mobile barriers 10 placed upwind 840 of active face 810 forming an upwind barrier 860 to control wind, thereby reducing suspension and transport of airborne contaminants from active face 810. The bulldozer 820 places the barriers immediately upwind 840 of the active face 810. These barriers would be equipped with closed screen material which allows approximately 50 percent of the wind to pass through, thereby reducing wind speed without creating turbulence. If desired, misting system 900 could be employed on upwind barrier 860.

I also anticipate that the mobile barrier may be useful for control of wind in agriculture, erosion control, and snow control. In view of the foregoing discussion such use would be obvious to persons with ordinary skills in these fields.

While my above description contains many specificities, these should not be construed as limitations on the scope of the invention, but rather as an exemplification of one preferred embodiment thereof. Many other variations are possible and are understood by those skilled in the art.

I claim:

1. A mobile barrier device for control of wind and windborne contaminants, the mobile barrier device comprising a freestanding base, two uprights extending generally upward from the base, a planar panel supported by the uprights, and adjustable lifting means, wherein the planar panel comprises a generally planar body having a panel front face, a panel rear face, and a thickness which is small relative to its width and length, the planar panel supported by a rigid frame, the rigid frame comprising peripheral support members which form a frame about the periphery of the planar panel, the rigid frame comprising cross support members which extend between peripheral support members to reinforce the planar panel, wherein each of the two uprights comprises an elongate tube of square cross section, the elongate tube having an upper end and a lower end, the lower end being opposed to the upper end and separated from it by the body of the elongate tube, the lower end being rigidly secured to the base such that the elongate tube is oriented at an angle which is 10 degrees from the vertical, wherein the adjustable lifting means comprises an elongate horizontally oriented lifting tube, the lifting tube comprising a first end which is adjustably secured to one of the two uprights, the lifting tube comprising a second end which is opposed to the first end and which is adjustably secured to the second of the two uprights, the lifting tube comprising means to releasably secure the mobile barrier to lifting and transporting machinery.

2. The mobile barrier device of claim 1 wherein the adjustable lifting means comprises means to allow vertical adjustment of the position of the lifting tube relative to the two uprights.

3. The mobile barrier device of claim 2 wherein the planar panel comprises a first percentage of open area such that it allows a first percentage of wind transmission therethrough, wherein the planar panel is selectively detachable fro the mobile barrier device, and replaceable with a second planar panel, the second planar panel having a second percentage of open area such that it allows a second percentage of wind transmission therethrough, where the first percentage of wind transmission is greater than the second percentage of wind transmission.

4. The mobile barrier device of claim 3 wherein a mist generating device is secured to the mobile barrier device, the mist generating device comprising fluid tanks, fluid pumps, fluid manifold, and spray nozzles, the fluid pumps propelling fluid from the fluid tanks to the fluid manifold, the fluid manifold being an elongate body extending horizontally adjacent the respective upper ends of the two uprights, the spray nozzles extending from the fluid manifold so as to project a fluid mist in a direction generally normal to the front panel face, so that when the mobile barrier device is in use while concurrently generating a mist, control of windborne contaminants is improved.

5. A mobile barrier device for control of wind and windborne contaminants, the mobile barrier device comprising a freestanding base, two uprights extending generally upward from the base, a planar panel supported by the uprights, wherein the base comprises a main longitudinal tube, a first transverse foot tube, and a second transverse foot tube, the main longitudinal tube lying generally in parallel with a bottom edge of the planar panel, the first transverse foot tube positioned at a first end of the main longitudinal tube and oriented perpendicularly to the main longitudinal tube, the second transverse foot tube positioned at a second end of the main longitudinal tube and oriented perpendicularly to the main longitudinal tube, and the main longitudinal tube, the first transverse foot tube, and the second transverse foot tube all lying in a single plane, wherein the planar panel comprises a generally rigid planar body having a panel front face, a panel rear face, and a thickness which is small relative to its width and length, the planar panel supported by a rigid frame, the rigid frame comprising peripheral support members which form a frame about the periphery of the planar panel, the rigid frame comprising cross support members which extend between peripheral support members to reinforce the planar panel, wherein each of the two uprights comprises an elongate tube, the elongate tube having an upper end and a lower end, the lower end being opposed to the upper end and separated from it by the body of the elongate tube, the lower end being rigidly secured to the base such that the elongate tube is oriented at an angle which is 10 degrees from the vertical, wherein the mobile barrier device comprises an adjustable lifting means for lifting and transporting the mobile barrier device, the adjustable lifting means comprising an elongate horizontally oriented lifting tube, the lifting tube comprising a first end which is adjustably secured to one of the two uprights, the lifting tube comprising a second end which is opposed to the first end and which is adjustably secured to the second of the two uprights, the lifting tube comprising means to releasably secure the mobile barrier to lifting and transporting machinery.

6. The mobile barrier device of claim 5 wherein the adjustable lifting means comprises means to allow vertical adjustment of the position of the lifting tube relative to the two uprights.

7. The mobile barrier device of claim 5 wherein the planar panel is selected from the group consisting of i) expanded planar panels and ii) perforated planar panels and comprises a first percentage of open area such that it allows a first percentage of wind transmission therethrough, wherein the planar panel is selectively detachable from the mobile barrier device, and replaceable with a second planar panel, the second planar panel is selected from the group consisting of i) expanded planar panels and ii) perforated planar panels, the second planar panel having a second percentage of open area such that it allows a second percentage of wind transmission therethrough, where the first percentage of wind transmission is greater than the second percentage of wind transmission.

8. The mobile barrier device of claim 7 wherein a mist generating device is secured to the mobile barrier device, the mist generating device comprising fluid tanks, fluid pumps, fluid manifold, and spray nozzles, the fluid pumps propelling fluid from the fluid tanks to the fluid manifold, the fluid manifold being an elongate body extending horizontally adjacent the respective upper ends of the two uprights, the spray nozzles extending from the fluid manifold so as to project a fluid mist in a direction generally normal to the front panel face, so that when the mobile barrier device is in use while concurrently generating a mist, control of windborne contaminants is improved.

9. A system for control of litter and airborne contaminants comprising the combination of a mobile barrier device and a mist generating device, wherein the mobile barrier device comprises a freestanding base, the base comprising a generally elongate member having a first base end and a second base end which is opposed to the first end, the base extending in a generally horizontal orientation, a first and second upright support, each first and second upright support extending generally upward from the freestanding base, the first upright support located adjacent to the first base end, the second upright support located adjacent to the second base end, both first and second upright supports comprising a lower end which is secured to the base, and an upper end which is opposed to the lower end, and a body portion which extends between the upper end and the lower end, an adjustable boom extending generally horizontally between the first upright support and the second upright support, the adjustable boom having a first boom end, and a second boom end which is opposed to the first boom end, each first and second boom end comprising a sleeve portion which is sized and shaped to receive the body portion of an upright support therethrough, the sleeve portion being selectively securable to the upright support to allow vertical position adjustment of the adjustable boom relative to the upright support, panel securement means, the panel securement means comprising an upper panel securement means and a lower panel securement means, the upper panel securement means being fixed to the upper end of each upright support, the lower panel securement means being fixed to the lower end of each upright support, a panel member, the panel member comprising a planar panel and a rigid frame, the planar panel being bounded and supported by the rigid frame about its entire periphery, the panel member being planar and generally rectangular in shape such that the frame comprises an upper longitudinal edge, a lower longitudinal edge, the upper and lower longitudinal edges being separated by opposed vertical edges, the rigid frame comprising at least one reinforcing cross bar extending between opposed vertical edges and spaced apart from both the upper and lower longitudinal edges, at least one cross bar being secured to the upper panel securement means, and the lower longitudinal edge being secured to the lower panel securement means, the mist generating device comprising fluid tanks, fluid pumps, fluid manifold, and spray nozzles, the fluid pumps propelling fluid from the fluid tanks to the fluid manifold, the fluid manifold being an elongate body being secured to upper panel securement means, the spray nozzles extending from the fluid manifold so as to project a fluid mist in a direction generally normal to the panel member, so that when the mobile barrier device is in use while concurrently generating a mist, control of windborne contaminants is improved.

10. A method of using a mobile barrier misting system for control of litter and airborne contaminants, the system comprising at least one barrier misting unit, the barrier misting unit comprising the combination of mobile barrier device and a mist generating device, wherein the mobile barrier device comprises a freestanding base, the base comprising a generally elongate member having a first base end and a second base end which is opposed to the first base end, the base extending in a generally horizontal orientation, a first and second upright support, each first and second upright support extending generally upward from the freestanding base, the first upright support located adjacent to the first base end, the second upright support located adjacent to the second base end, both first and second upright supports comprising a lower end which is secured to the base, and an upper end which is opposed to the lower end, and a body portion which extends between the upper end and the lower end, an adjustable boom extending generally horizontally between the first upright support and the second upright support, the adjustable boom having a first boom end, and a second boom end which is opposed to the first boom end, each first and second boom end comprising a sleeve portion which is sized and shaped to receive the body portion of an upright support therethrough, the sleeve portion being selectively securable to the upright support to allow vertical position adjustment of the adjustable boom relative to the upright support, panel securement means, the panel securement means comprising an upper panel securement means and a lower panel securement means, the upper panel securement means being fixed to the upper end of each upright support, the lower panel securement means being fixed to the lower end of each upright support, a panel member, the panel member comprising a planar panel and a rigid frame, the planar panel being bounded and supported by the rigid frame about its entire periphery, the panel member being planar and generally rectangular in shape such that the frame comprises an upper longitudinal edge, a lower longitudinal edge, the upper and lower longitudinal edges being separated by opposed vertical edges, the rigid frame comprising at least one reinforcing cross bar extending between opposed vertical edges and spaced apart from both the upper and lower longitudinal edges, the at least one cross bar being secured to the upper panel securement means, and the lower longitudinal edge being secured to the lower panel securement means, the mist generating device comprising fluid tanks, fluid pumps, fluid manifold, and spray nozzles, the fluid pumps propelling fluid from the fluid tanks to the fluid manifold, the fluid manifold being an elongate body being secured to upper panel securement means, the spray nozzles extending from the fluid manifold so as to project a fluid mist in a direction generally normal to the panel member, so that when the mobile barrier device is in use while concurrently generating a mist, control of windborne contaminants is improved, the method of using the system comprising the following steps, step 1. identify target area in which litter and airborne contaminants are to be controlled, step 2. identify direction of wind flow through the target area so as to determine the upwind side of the target area and the downwind side of the target area, step 3. place at least one barrier misting unit immediately adjacent the target area such that it lies within the upwind side of the target area, and such that the panel member outer face confronts the direction of wind flow, and the panel member inner face confronts the target area, step 4. activate the mist generating device so cause a fine mist to be projected over the target area so that airborne litter and contaminants are wetted by the mist and subsequently are less buoyant and tend to fall to the ground within the target area.

11. The method of claim 10 wherein the system comprises at least two barrier misting units, the method of using the system comprising this additional step after step 3, step 3a. place at least one second barrier misting unit immediately adjacent to the at least one first barrier misting unit such that the panel member of the second barrier misting unit is generally coplanar with the panel member of the first barrier misting unit.

12. The method of claim 11 wherein the system comprises at least two barrier misting units, wherein the screen mesh of the panel member comprises a first percentage of open area such that it allows a first percentage of wind transmission therethrough, wherein the system comprises at least one barrier non-misting unit, the barrier non-misting unit comprising a mobile barrier device with no mist generating device, the barrier non-misting unit comprising a second panel member, the second panel member comprising a second planar panel, the second planar panel having a second percentage of open area such that it allows a second percentage of wind transmission therethrough, where the first percentage of wind transmission is greater than the second percentage of wind transmission, the method of using the system comprising the following method step 5, step 5. place at least one barrier non-misting unit such that it lies immediately adjacent the target area such that it lies within the downwind side of the target area, and such that the panel member outer face confronts the target area.

13. The method of claim 12 wherein the system comprises at least two barrier non-misting units, the method of using the system comprising this additional step after step 5, step 6. place at least one second barrier non-misting unit immediately adjacent to the at least one first barrier non-misting unit such that the panel member of the second barrier non-misting unit is generally coplanar with the panel member of the first barrier non-misting unit.

14. The method of claim 10 wherein the at least one barrier misting unit is positioned about the target area using power lifting and transporting machinery, wherein the adjustable boom provides a means to selectively secure a mobile barrier unit to the power lifting and transporting machinery.

* * * * *